US009114293B2

(12) United States Patent
Soracco

(10) Patent No.: US 9,114,293 B2
(45) Date of Patent: Aug. 25, 2015

(54) GOLF CLUB WITH MULTI-COMPONENT CONSTRUCTION

(71) Applicant: Cobra Golf Incorporated, Carlsbad, CA (US)

(72) Inventor: Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 249 days.

(21) Appl. No.: 13/887,879

(22) Filed: May 6, 2013

(65) Prior Publication Data

US 2013/0252755 A1 Sep. 26, 2013

Related U.S. Application Data

(63) Continuation-in-part of application No. 12/761,377, filed on Apr. 15, 2010, now Pat. No. 8,734,265.

(51) Int. Cl.

| | |
|---|---|
| ***A63B 53/04*** | (2015.01) |
| ***A63B 53/06*** | (2015.01) |
| *A63B 53/02* | (2015.01) |

(52) U.S. Cl.

CPC ..... *A63B 53/0466* (2013.01); *A63B 53/06* (2013.01); *A63B 2053/026* (2013.01); *A63B 2053/042* (2013.01); *A63B 2053/0408* (2013.01); *A63B 2053/0416* (2013.01); *A63B 2053/0433* (2013.01); *A63B 2053/0437* (2013.01); *A63B 2053/0491* (2013.01)

(58) Field of Classification Search

CPC ..... A63B 53/0433

USPC ..... 473/324–351

See application file for complete search history.

(56) References Cited

U.S. PATENT DOCUMENTS

| | | | | | |
|---|---|---|---|---|---|
| 1,531,821 | A | * | 3/1925 | Lewis | 473/328 |
| 1,916,792 | A | | 7/1933 | William | |
| 2,026,749 | A | | 1/1936 | Pester | |
| 2,550,846 | A | * | 5/1951 | Milligan | 473/327 |
| 2,715,598 | A | | 8/1955 | Rees et al. | |
| 3,190,651 | A | | 6/1965 | Thomas | |
| D240,948 | S | * | 8/1976 | Redouty | D21/747 |
| 3,976,299 | A | * | 8/1976 | Lawrence et al. | 473/327 |
| D247,922 | S | * | 5/1978 | Sheldon | D21/752 |
| 4,194,739 | A | | 3/1980 | Thompson | |
| 4,431,192 | A | * | 2/1984 | Stuff, Jr. | 473/327 |
| 4,618,149 | A | | 10/1986 | Maxel | |
| 4,828,265 | A | * | 5/1989 | Antonious | 473/327 |
| 4,850,593 | A | * | 7/1989 | Nelson | 473/328 |

(Continued)

FOREIGN PATENT DOCUMENTS

| | | | | |
|---|---|---|---|---|
| EP | 659452 A1 | * | 6/1995 | A63B 53/04 |
| GB | 427521 A | | 4/1935 | |

(Continued)

OTHER PUBLICATIONS

Extended European Search Report dated Jul. 23, 2012, 13 pages.

*Primary Examiner* — Alvin Hunter

(74) *Attorney, Agent, or Firm* — Brown Rudnick LLP; Mark S. Leonardo

(57) ABSTRACT

A golf club head with multi-component construction. The golf club head includes heel and toe portions that generally provide ground contacting surfaces and a raised central region. A portion of a club head wall is spaced away from a second portion of the club head wall by a less than about 2 cm.

10 Claims, 19 Drawing Sheets

(56) References Cited

U.S. PATENT DOCUMENTS

| | | | | | |
|---|---|---|---|---|---|
| 4,930,783 | A | * | 6/1990 | Antonious | 473/242 |
| 5,451,056 | A | | 9/1995 | Manning | |
| 5,464,217 | A | * | 11/1995 | Shenoha et al. | 473/350 |
| 5,467,988 | A | | 11/1995 | Henwood | |
| 5,476,262 | A | * | 12/1995 | Bandiero | 473/409 |
| 5,497,995 | A | * | 3/1996 | Swisshelm | 473/350 |
| 5,516,106 | A | | 5/1996 | Henwood | |
| 5,630,766 | A | * | 5/1997 | Granelli | 473/313 |
| 5,643,107 | A | | 7/1997 | Gorman | |
| 5,683,307 | A | * | 11/1997 | Rife | 473/313 |
| D393,032 | S | * | 3/1998 | Stone et al. | D21/733 |
| 5,735,754 | A | | 4/1998 | Antonious | |
| D397,387 | S | * | 8/1998 | Allen | D21/733 |
| D398,349 | S | * | 9/1998 | Butler | D21/733 |
| 5,888,148 | A | | 3/1999 | Allen | |
| 6,299,546 | B1 | | 10/2001 | Wang | |
| 6,354,961 | B1 | | 3/2002 | Allen | |
| 6,422,951 | B1 | | 7/2002 | Burrows | |
| 6,663,503 | B1 | | 12/2003 | Kenmi | |
| 7,335,112 | B1 | | 2/2008 | Bitondo | |
| 7,641,568 | B2 | | 1/2010 | Hoffman et al. | |
| 7,753,809 | B2 | * | 7/2010 | Cackett et al. | 473/345 |
| 7,828,676 | B2 | * | 11/2010 | Wada et al. | 473/346 |
| 8,556,742 | B2 | * | 10/2013 | John | 473/219 |
| 8,591,354 | B2 | * | 11/2013 | Yokota | 473/346 |
| 8,628,433 | B2 | * | 1/2014 | Stites et al. | 473/327 |
| 8,657,703 | B2 | * | 2/2014 | Wada et al. | 473/335 |
| 8,678,948 | B2 | * | 3/2014 | Wada et al. | 473/332 |
| 8,727,910 | B2 | * | 5/2014 | Nakano | 473/346 |
| 8,747,251 | B2 | * | 6/2014 | Hayase et al. | 473/332 |
| 8,764,579 | B2 | * | 7/2014 | Ban | 473/346 |
| 8,771,097 | B2 | * | 7/2014 | Bennett et al. | 473/246 |
| 8,858,363 | B2 | * | 10/2014 | Wada et al. | 473/346 |
| 2002/0098903 | A1 | | 7/2002 | Antler | |
| 2003/0045371 | A1 | | 3/2003 | Wood et al. | |
| 2004/0029653 | A1 | | 2/2004 | Whitehill et al. | |
| 2010/0009771 | A1 | * | 1/2010 | Newcomer | 473/327 |
| 2011/0256954 | A1 | * | 10/2011 | Soracco | 473/328 |
| 2013/0029780 | A1 | | 1/2013 | Beno et al. | |
| 2013/0059678 | A1 | | 3/2013 | Stites et al. | |
| 2013/0085013 | A1 | | 4/2013 | Stites et al. | |
| 2013/0130834 | A1 | | 5/2013 | Stites et al. | |

FOREIGN PATENT DOCUMENTS

| | | | | | |
|---|---|---|---|---|---|
| GB | 591595 | A | | 8/1947 | |
| JP | 06142240 | A | * | 5/1994 | A63B 53/04 |
| JP | 07204299 | A | * | 8/1995 | A63B 53/04 |
| JP | 10033723 | A | * | 2/1998 | A63B 53/04 |
| JP | 10118229 | A | | 5/1998 | |
| JP | 10151229 | A | * | 6/1998 | A63B 53/04 |
| JP | 2000317018 | A | * | 11/2000 | A63B 53/04 |
| JP | 2003102877 | A | * | 4/2003 | A63B 53/04 |
| JP | 2004237039 | A | | 8/2004 | |
| JP | 2005230230 | A | * | 9/2005 | A63B 53/04 |
| JP | 2006075430 | A | * | 3/2006 | |
| JP | 2006116208 | A | * | 5/2006 | |
| JP | 04327865 | B2 | | 9/2009 | |

* cited by examiner

GOLF CLUB WITH MULTI-COMPONENT CONSTRUCTION

CROSS-REFERENCE TO RELATED APPLICATION

This application is a continuation-in-part of U.S. patent application Ser. No. 12/761,377, filed Apr. 15, 2010, the contents of which are incorporated by reference.

FIELD OF THE INVENTION

This invention generally relates to wood-type golf club heads.

BACKGROUND

To succeed in golf, a golfer must hit a ball a long distance in the right direction. By the 1990s, it had become accepted wisdom that a wood-type club with a large, hollow head was the best tool for that job. The idea was that an oversized head gives the club a large sweet spot, which helps the ball fly a long distance in the right direction. A typical driver head has a minimal surface area per volume and has no substantial concavities or indentations. Designers believe that such designs give the best compromise on sweet spot, aerodynamics, and mass distribution.

Typical club heads are made of layered composite materials or metals that must be at least a certain thickness (e.g., at least six layers of composite) for strength. A club head designer that wants to free up discretionary mass will bring the thickness of the club head walls down to the minimum while simultaneously minimizing the surface-area-to-volume within allowable design constraints. The idea has been that thinning walls down to the structural limit and minimizing surface area frees up the most possible discretionary mass.

SUMMARY

The invention provides a golf club head with good mass distribution by having a compressed area in which portions of two opposed club head walls are proximal to one another throughout an area, allowing those two portions to support each other and be thinner than what is otherwise the structural limit of the material. For example, where a club head uses a layered composite that otherwise requires at least six layers for structural integrity, a portion of the crown can be brought adjacent to a portion of the sole and each of those portions can have only three layers while those portions combine to provide six layers of material. Any portions of club head walls can be compressed together to be proximal to one another to provide a club head with "freed up" discretionary mass. Bringing opposed portions of the club head walls together, or compressing a portion of the club head, can be accomplished by including one or more sculpted walls that define one or more substantial concavities. Since the material of the wall in the adjacent portions can be made thinner, decreasing mass, discretionary mass can be placed at locations in the club head that increase moment of inertia or that improve the location of the center of gravity. Inclusion of adjacent portions of the walls can also contribute to the support of a large striking face and give a good coefficient of restitution. Thus, the adjacent, opposed wall portions allow for a mass distribution that aids in hitting a ball in the right direction and a structure supporting the face area that aids in hitting the ball a long distance.

A concavity can be included on the crown, the sole, or both, that is roughly centered in a heel-toe direction and is spaced away from the striking face by at least a centimeter or so. The inward-facing side walls of the concavities cooperate with the outward facing heel and toe walls of the club head to present pontoon-like bodies disposed at the heel and toe sides of a central bridge portion. The innermost floor or ceiling walls of concavities in the crown or sole, respectively, define a central bridge portion extending between the pontoon-like bodies. When the club is at address, the central bridge portion can be substantially horizontal, angled away from the horizontal, curved, or a combination thereof and can be disposed at a crown-most height within the club head, at a sole-most height, or any point in between. Different club heads can have a bridge portion at different heights for players with different needs. The bridge portion need not make contact with a back of the striking face—allowing the striking face to exhibit a high coefficient of restitution—but does contribute mass to the momentum of the club head and to the impulse given to the golf ball. The angle of bridge portion (e.g., horizontal or extending upwards from the heel to the toe from the horizontal when the club head is at address) and the mass of the pontoon-like body walls give a good moment of inertia about a Z axis ($I_{ZZ}$) that is vertical when the club head is at address. Clubs with a high IZZ are forgiving to off-center hits in that they tend to propel the ball in the right direction. Clubs with a high coefficient of restitution tend to send the ball a long distance. Thus, a club head of the invention can help a golfer succeed in golf.

In certain aspects, the invention provides a wood-type golf club head having a striking face with a crown portion extending from the face and a sole portion extending from the face and joining the crown portion at a heel side, a toe side, and an aft area when the club head is at address. The head includes a hosel extending from the heel side. The club head is constructed such that a first portion of a club head wall is spaced away from a second portion of the club head wall over an area and preferably substantially equidistant over the area. The two portions may be spaced apart by a bridge thickness of about 2 cm or less over an area of at least about 1 $cm^2$. Preferably, the bridge thickness is less than about 1 cm. In some embodiments, the first portion is within the crown portion and the second portion is within the sole portion. The club head may include a crown recess in the crown portion, in which the first portion defines a crown recess floor facing upward when the club is at address. A portion of the crown recess floor may be lower than an upward-facing upper crown surface by a recess depth of at least about 2 cm when the club is at address. The portion of the crown recess floor and part of the sole define a compressed portion. Preferably, the crown recess has a heel-facing inside portion extending down from the upper crown surface; a toe-facing inside portion extending down from the upper crown surface and facing the heel-facing inside portion; and an aft-facing portion extending down from the upper crown surface and extending between the heel-facing inside portion and the toe-facing inside portion.

In some embodiments, a portion of the crown recess floor is spaced away from the sole portion by a bridge thickness that is less than about 2 cm. The bridge thickness may be less than about 1 cm. A portion of the crown recess floor may be angled upwards from the heel side towards the toe side to define a rise angle (e.g., between about 20° and about 40°) with the horizontal when the club is at address.

In certain embodiments, the club head also includes a sole recess in the sole portion. The sole recess has a second heel-facing inside portion extending upwards from a lower sole surface, a second toe-facing inside portion extending upwards from the lower sole surface and facing the heel-facing inside portion, a second aft-facing portion extending upwards from the lower sole surface and between the second heel-facing inside portion and the second toe-facing inside portion, and a sole recess ceiling facing downwards when the club is at address.

In related aspects, the invention provides a golf club head having a crown body with a heel portion and a toe portion as well as a heel body extending downward from the heel portion of the crown and a toe body extending downward from the toe portion of the crown. A sole surface includes a lower surface of the heel body, a lower surface of the toe body, and a raised central sole surface of the club head and extends between the heel and toe bodies. A face body provides a ball striking surface. The face body extends forward from the crown body, the heel body, the toe body, and the raised central sole surface. The raised central sole surface does not form a part of the face body. The heel body, the toe body, the raised central sole surface, and the face body combine to define a central cavity underneath the club head. The central cavity is openly exposed downward. An upper surface of the crown body is spaced away from the raised central sole surface by a bridge thickness that is less than about 2 cm. The raised central sole surface may be higher than the lower surface of the heel body by a recess depth that is at least about 2 cm when the club is at address. The bridge thickness can be less than about 1 cm.

In some embodiments, a portion of the raised central sole surface is angled upwards from the heel body towards the toe body to define a rise angle (e.g., between about 20° and about 40°) with the horizontal when the club is at address.

The club head may include a crown recess in which a crown recess floor faces upward when the club is at address. Part of the crown recess floor may be lower than an upward-facing upper crown surface by a recess depth of at least about 0.1 cm when the club is at address. The recess depth may be at least about 2 cm.

Aspects of the invention provide a golf club head with a striking face, a crown portion extending from the face, and a sole portion extending from the face and joining the crown portion at a heel side, a toe side, and an aft area when the club head is at address. A span member is included as part of the crown that is spaced away from an area of the sole by a bridge thickness that is not greater than about 2 cm or even about 1 cm. A portion of the crown is spaced away from a portion of the sole by a vertical distance that is greater than about 2 cm in a heel-ward, forward, and toe-ward direction of the span member when the club head is at address. The span member may include a raised central sole surface that faces downwards and is angled upwards from the heel side towards the toe side to define a rise angle (e.g., between about 30° and about 40°) with the horizontal when the club is at address. In some embodiments, the area of the crown that is spaced away from an area of the sole by the bridge thickness has a surface area of at least 3 $cm^2$. In certain embodiments, an entirety of the crown portion is convex upwards with no concave areas.

In an embodiment, a golf club head includes a crown body, a heel body, a toe body and a face body. The crown body includes a heel portion and a toe portion. The heel body extends downward from the heel portion of the crown and the toe body extends downward from the toe portion of the crown. The face body includes a ball striking surface, and extends forward from the crown body, the heel body and the toe body. The heel body, the toe body, and the face body combine to define a central cavity that is openly exposed downward. A center of gravity of the golf club head is disposed within the central cavity between the heel body and the toe body, and an axis of percussion does not intersect a raised central portion of a sole surface of the club head.

In another embodiment, a golf club head includes a crown body, a heel body, a toe body, and a face body. The crown body includes a heel portion and a toe portion. The heel body extends downward from the heel portion of the crown and the toe body extends downward from the toe portion of the crown. The face body includes a ball striking surface and extends forward from the crown body, the heel body and the toe body. The heel body, the toe body, and the face body combine to define a central cavity that is openly exposed downward and at least one of the heel body and the toe body has a portion having a maximum lateral dimension in a heel to toe direction that is spaced from the face body.

In a further embodiment, a golf club head includes a crown body, a heel body, a toe body, a face body, a hinge and a hinge locking mechanism. The crown body includes a heel portion and a toe portion. The heel body extends downward from the heel portion of the crown and the toe body extends downward from the toe portion of the crown. The face body including a ball striking surface. The hinge couples the face body to a second body member that is one of the crown body, the heel body and the toe body. The hinge locking mechanism is configured to retain the face body in a predetermined angular orientation relative to the second body member.

DETAILED DESCRIPTION

Figure 1:
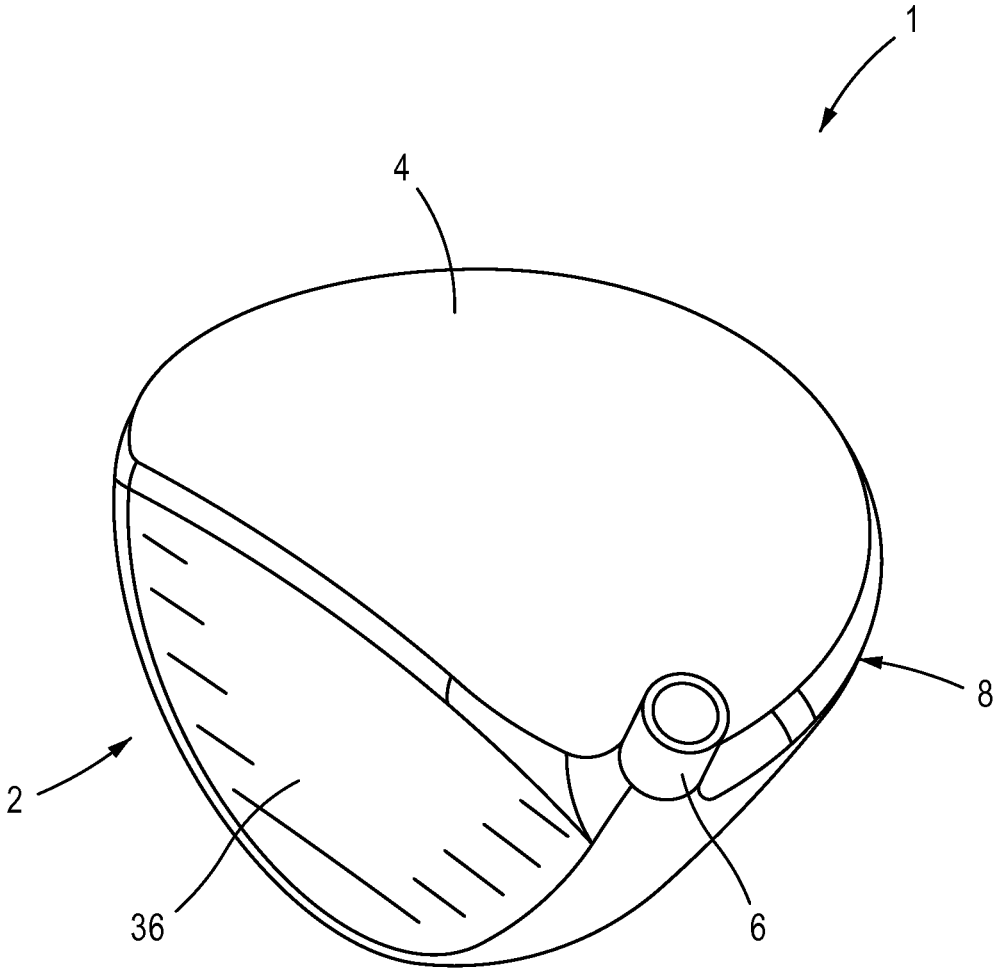
FIG. 1 is a perspective view of a golf club head of the present invention.

The present invention is directed to a golf club head including a compressed portion in which two portions of opposed club head walls are proximal to one another over an area. Several embodiments of the present invention are described below.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

A golf club head of the invention includes at least one compressed portion in which two opposed walls extend for an area proximal to one another. The area is preferably at least about a quarter of a centimeter squared and proximal may mean less than about 2 cm apart, preferably less than about 1 cm apart. Any portion of a club head can provide a compressed portion in which two opposed walls are proximal (e.g., less than a few cm apart) for an area (e.g., <about 0.5 $cm^2$). In some embodiments, a compressed area is near a middle of the club head in a heel-toe direction, a face-aft direction, or both. A compressed area may include a surface of the crown or any other part.

Where a club head component is made of pre-preg composite, it may be found that a wall should include at least about 6 layers or sheets of the composite material to be strong enough (or 5, or 7 or so). By bringing together portions of the walls to be proximal to one another over an area, those proximal portions can support one another by direct contact or through an intermediary supporting material and in the proximal areas, each wall can include fewer layers than the 6 or so otherwise desired. For example, each wall can include 3 layers or sheets of composite material so that over the area where the opposed walls are proximal one another, the walls, considered together, exhibit 6 total thicknesses of the material.

Referring first to FIGS. 1-6, a golf club head including a construction of the present invention will be described. Golf club head 1 generally includes a face body member 2 that includes a forward ball-striking surface, a crown 4, a hosel 6, a heel body member 8 and a toe body member 10. Rather than having a sole surface that generally matches the plan area of the crown, club head 1 includes an unconventional construction by including a raised central body portion of the golf club head and elongate lateral sole portions, or pontoons, formed by heel body member 8 and toe body member 10 that combine to define a central cavity on the underside of the club head that is opened downward. The central cavity is defined, in part, by inward facing walls 520 and aft-facing wall 521. The depth of a cavity generally relates to a vertical extent of one of these walls when the club head is at address. As can be seen, for example, in FIG. 3, a compressed area—surrounded by inward facing walls 520 and aft-facing wall 521—includes a portion of the crown wall being proximal to a portion of the sole wall (e.g., less than about 1 cm apart).

Figure 2:
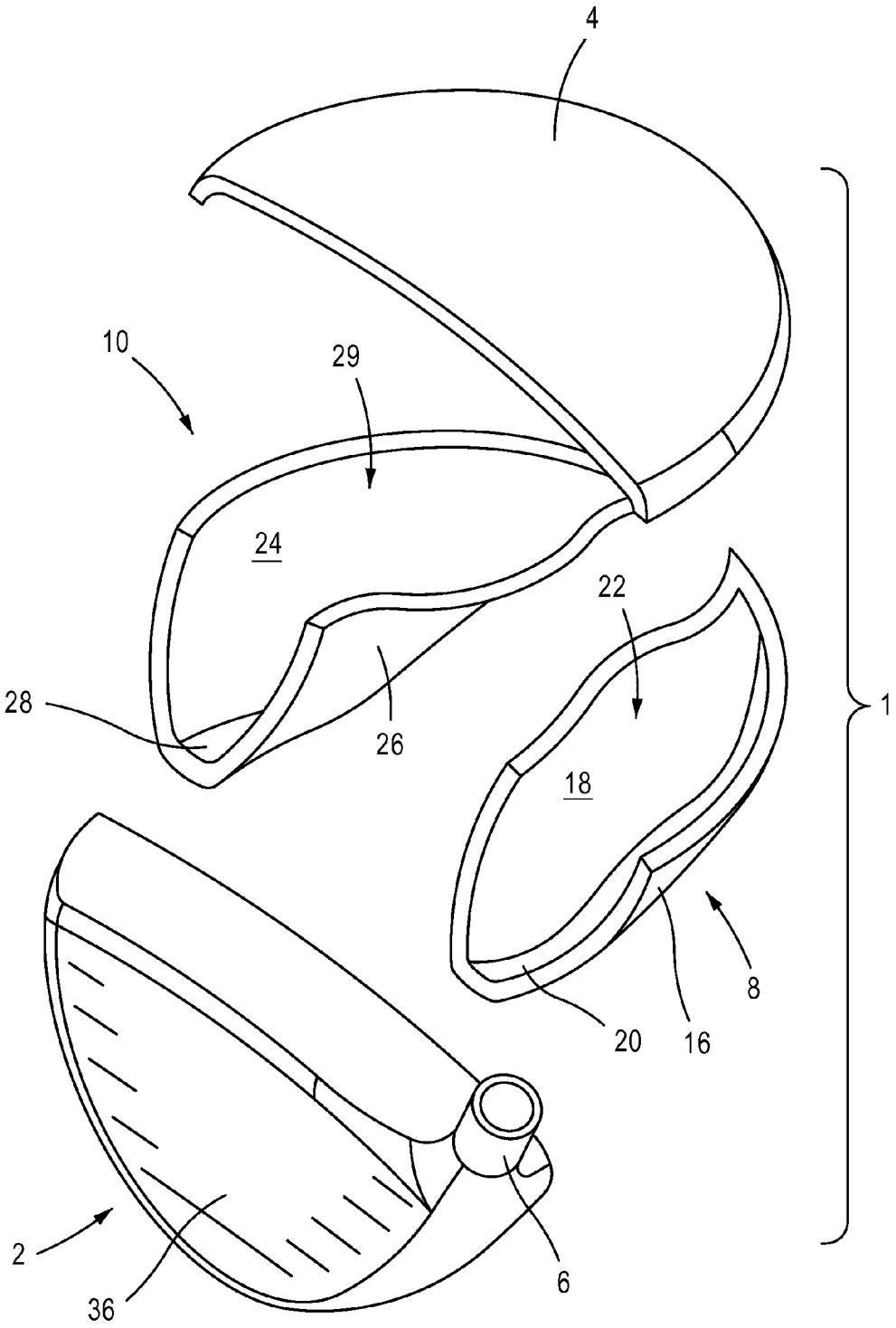
FIG. 2 is an exploded view of the golf club head of FIG. 1.
Figure 3:
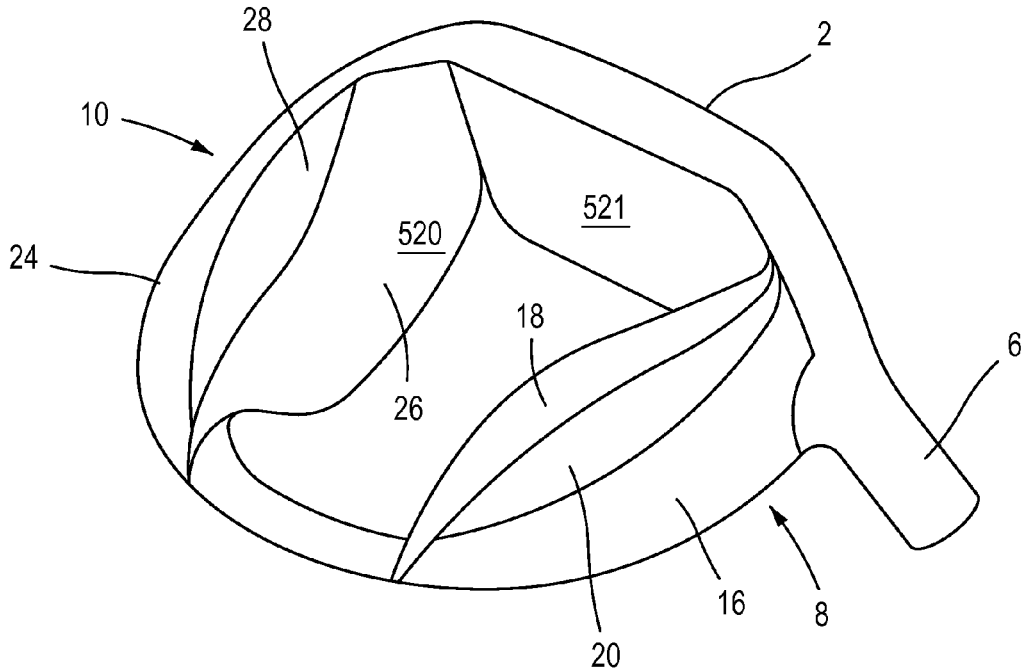
FIG. 3 is a bottom perspective view of the golf club head of FIG. 1.
Figure 4:
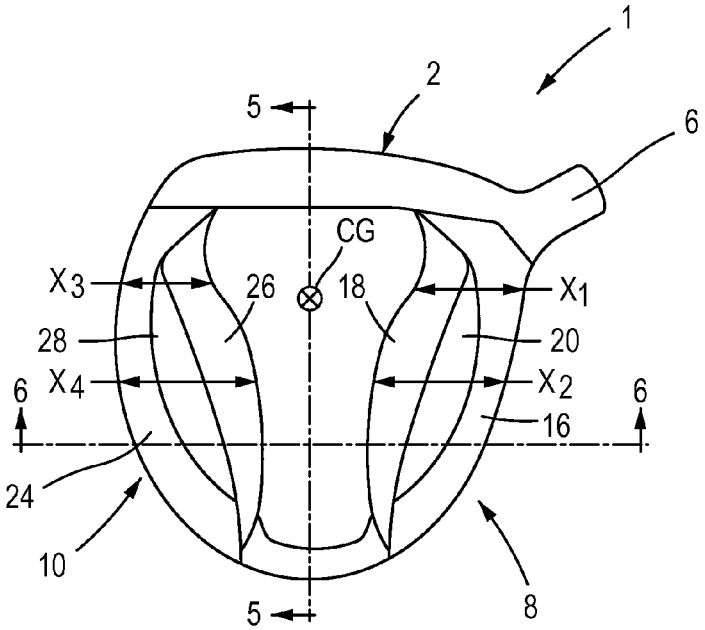
FIG. 4 is a bottom view of the golf club head of FIG. 1.

In the present embodiment, heel body member 8 and toe body member 10 are separate shell members that are coupled to crown 4 and face member 2, as shown in FIG. 2. Heel body member 8 extends rearward from face member 2 on a heel side of the golf club head. An outer wall 16 of heel body member 8 is coupled to crown 4 along a heel portion of the perimeter of crown 4. Outer wall 16 extends downward from crown 4 and joins with an inner wall 18 and a sole wall 20. Inner wall 18 extends upward from sole wall 20 and is coupled to crown 4 at a location spaced inward from the perimeter of crown 4. Heel body member 8 combines with face member 2 and crown 4 to define a heel cavity 22. Preferably, the heel cavity forms about 10% to about 30% of the total enclosed volume of golf club head 1 and heel body member 8 is coupled to crown 4 over about 10% to about 35% of the periphery of crown 4.

Heel body member 8 has a lateral outer dimension that changes over its length. For example, the maximum outer dimension is located at an intermediate location along heel body portion 12, indicated by dimension $X_2$ of FIG. 4. Preferably, the lateral dimension tapers to a point at an aft end of heel body portion 12 and to a predetermined dimension $X_1$ is less than dimension $X_2$ at a forward end of heel body member 8 adjacent face member 2. Furthermore, in the present embodiment, heel body member 8 is generally tapered from crown 4 to sole wall 20 so that it narrows from the crown toward the sole wall, but it should be appreciated that the heel body member may alternatively be tapered so that it widens from the crown toward the sole wall to further concentrate mass lower in the golf club head.

Toe body member 10 also extends rearward from face member 2. Toe body member 10, however is disposed on a toe side of the golf club head. Toe body member 10 includes an outer wall 24 and an inner wall 26 that combine with a toe ward sole wall 28 and a portion of crown 4 to define a hollow toe cavity 29. The hollow body forms about 10% to about 30% of the total enclosed volume of golf club head 1 and toe body member 10 is coupled to crown 4 over about 10% to about 35% of the periphery of crown 4.

Toe body member 10 has a lateral outer dimension that changes over its length, similar to the heel body member. For example, the maximum outer dimension $X_4$ is located at an intermediate location along toe body member 10 from a reduced dimension $X_3$ adjacent face member 2. Additionally, toe body member 10 is tapered so that it narrows from crown 4 to sole wall 28. It should be appreciated that the toe body member may alternatively be tapered so that it widens from the crown toward the sole wall to further concentrate mass lower in the golf club head. Each of the heel and toe body members has a reduced dimension adjacent the face member so that the impact on the flexibility of the face member is reduced. In particular, the face member is preferably flexible so that a desired coefficient of restitution may be achieved. The dimension is reduced so that the heel and toe members do not unduly increase the rigidity of the face.

Figure 5:
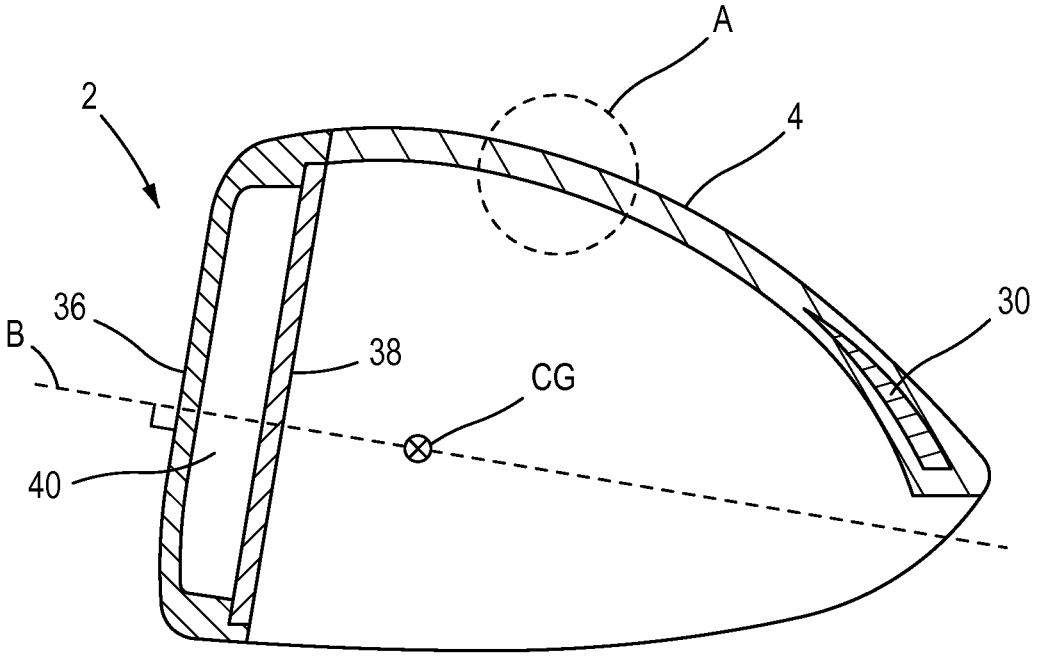
FIG. 5 is a cross-sectional view of the golf club head of FIG. 1.
Figure 6:
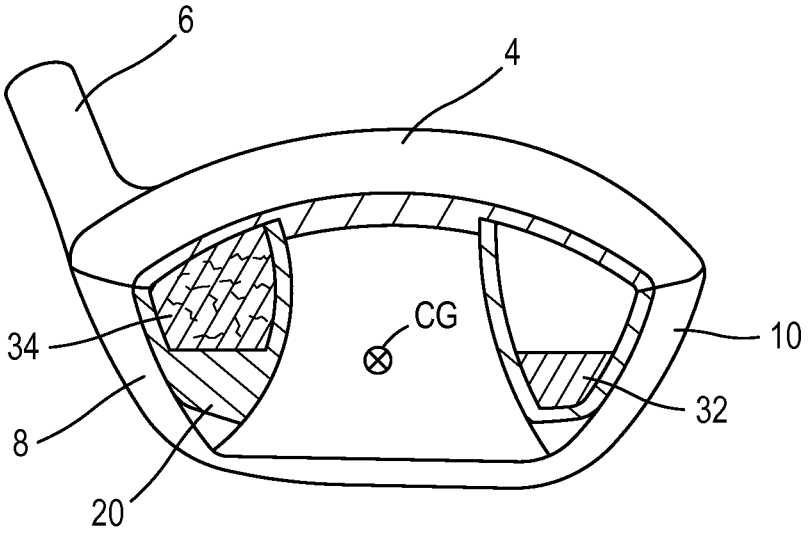
FIG. 6 is a cross-sectional view of the golf club head of FIG. 1.

In the present embodiment, crown 4 forms the raised central body portion 13 and extends between heel body member 8 and toe body member 10 to rigidly couple the body portions. From above, crown 4 includes a continuous bulbous top surface so that when golf club head 1 is placed in an address position by a golfer it provides the appearance of a conventional golf club head. Crown 4, as shown in FIGS. 5 and 6, is constructed in a first configuration in which crown 4 includes a thickness and is constructed from a selected material to provide the desired structural rigidity. Additionally, a lower surface of crown 4 also forms the lower surface of the raised central body portion 13. Because of that construction, a center of gravity of golf club head 1 is located within the central cavity, below central portion 13, and outside of an envelope defined by the outer surfaces of club head 1. In particular, the center of gravity is located below the lower surface of crown 4 and between heel body member 8 and toe body member. Preferably, an axis of percussion B, i.e., an axis extending from the ball-striking face orthogonally and through the center of gravity, does not intersect a sole surface of the club head. As used herein, "sole surface" refers to the lowermost downward facing surface of the club head, which may be the lower surface of a crown member or a lower surface of a sole member depending on the particular construction. As a result a central portion of the sole surface is substantially above a center of percussion of the golf club head. As a result, the rigidity of the face is not increased significantly by the central portion.

The structure of golf club head 1 provides ground contacting surfaces on both of heel body member 8 and toe body member 10 and concentrates the mass of the club head toward the heel and toe. As a result, the stability of the club head during address is increased and the moment of inertia of the club head may be more easily manipulated while the face may remain flexible to optimize the coefficient of restitution.

Crown 4 may have a multi-material structure. For example, crown 4 may include one or more weight members 30. Weight members 30 may be located in any portion of crown 4 and may be embedded or attached thereto. For example, weight members 30 may be co-molded or cast into crown 4 or they may be coupled to an inner or an outer surface of crown 4. In the illustrated embodiment, weight member 30 is disposed in a rear central portion of crown 4, but it should be appreciated that weight members 30 may be included in heel ward and/or toe ward locations to impart any desired draw or fade biased ball flight or to locate the center of gravity or to achieve a desired moment of inertia to impart a desired forgiveness to the golf club head.

Any material may be used to construct the face member, the crown, the toe body member and the heel body member, such as any metallic or non-metallic material. For example, the components may be constructed from titanium, steel, magnesium, aluminum, carbon fiber, abs plastic, and alloys thereof. Additionally, in a club head the components may be constructed from different materials to provide a desired mass distribution. The components may be cast, injection molded, forged, stamped, hydro-formed, direct sintered, and/or machined.

Additional body weight members 32 may be incorporated into one or both of heel body member 8 and toe body member 10. Body weight members 32 are generally constructed froth a material different than the material of the body members that has a higher specific weight than the body member material. Alternatively, the wall thicknesses of the body members may be altered to provide a desired mass distribution. For example, in the present embodiment, sole wall 20 of heel body member 8 has a thickness that is significantly greater than either of outer wall 16 or inner wall 18. Any portion of heel cavity 22 and/or toe cavity 29 remaining in the heel and/or toe body members after the inclusion of weighting materials may be filled with a filler material 34, such as foam, that preferably has a lower specific weight than the materials of the body and any weights.

The face member may also have many different configurations. In the present embodiment, face member 2 is constructed from a ball-striking member 36 that is coupled to a rear face member 38 and hosel 6. Ball-striking member 36 and back plate 38 combine to define a face cavity 40. Ball-striking member 36 may have a constant thickness or it may have varying thickness to provide any desired coefficient of restitution.

Figure 7:
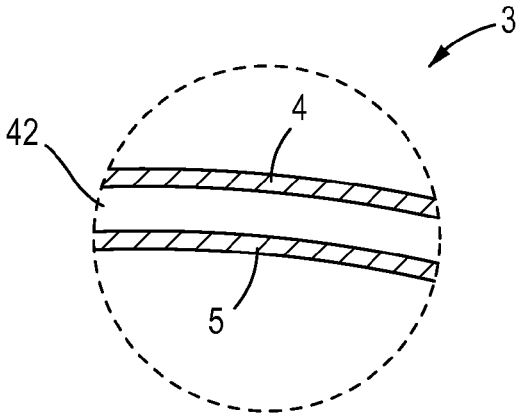
FIG. 7 is a cross-sectional view of an alternative construction of a club head.

Various alternatives are available to construct the golf club head. In particular, although the embodiment shown in FIGS. 1-6 does not include a separate sole body member, various alternative constructions are available, as illustrated in detail in FIGS. 7-9, that include both a crown 4 and a sole 5. FIG. 7 illustrates an embodiment that includes crown 4 spaced from sole 5 by a crown cavity 42.

Figure 8:
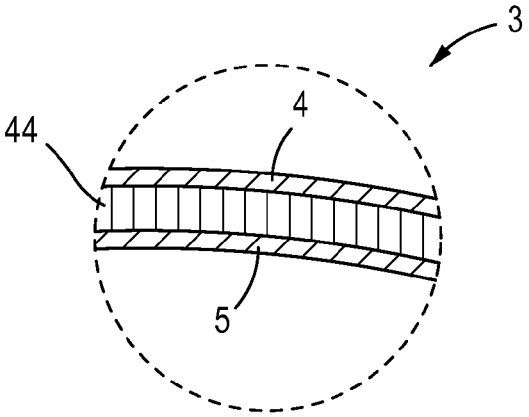
FIG. 8 is a cross-sectional view of an alternative construction of a club head.
Figure 9:
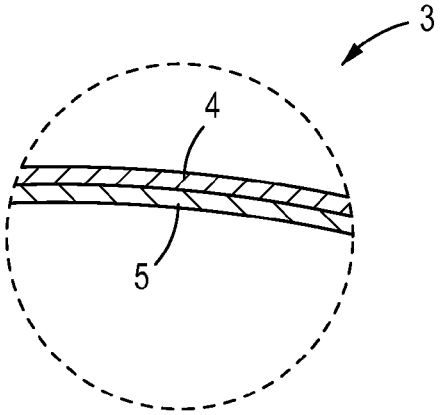
FIG. 9 is a cross-sectional view of an alternative construction of a club head.

Moreover, FIGS. 7-9 illustrate a golf club head with good mass distribution by having a compressed area in which portions of two opposed club head walls are proximal to one another throughout an area, allowing those two portions to support each other and be thinner than what is otherwise the structural limit of the material. Any two portions of a club head can be included in a compressed area. In some embodiments, crown 4 is proximal to sole 5. Preferably, crown 4 is spaced from sole by no more than 1.0 cm. Even with no material extending between them, as shown in FIG. 7, this structure may provide additional strength allowing each wall to be thinner than what would otherwise be a structural limit. For example, where a club head uses a layered composite that otherwise requires, e.g., four layers for structural integrity, the portions of the opposed walls can be made proximal to one another and each could include only two or three layers. Any material can be used in the walls such as, for example, a thermoplastic material, composite, metal (e.g., titanium, steel, aluminum, an alloy), or any other material, or a combination thereof. Any portions of club head walls can be compressed together to be proximal to one another to provide a club head with "freed up" discretionary mass.

Alternatively, the crown cavity 42 may include a filler 44, such as a cellular honeycomb material, foam or any other lightweight material that separates crown 4 from sole 5, as shown in FIG. 8. Filler 44 may be fiberboard, cardboard, plastic, foam, metal, a thermoplastic, balsa wood, or any other suitable material. As a further alternative, crown 4 and sole 5 may be separate components that are directly attached to each other so that there is no cavity or filler, as shown in FIG. 9. It should be appreciated that the crown and the sole need not be the same material. Preferably, the crown or combination of crown and sole is selected that provides desired rigidity between the heel portion, the toe portion and the face while minimizing mass so that the mass may be concentrated in the heel portion and the toe portion.

Since the material of the wall in the adjacent portions is made thin, with low mass, discretionary mass can be placed at locations in the club head that increase moment of inertia or that improve the location of the center of gravity. Inclusion of adjacent portions of the walls can also contribute to the support of a large striking face and give a good coefficient of restitution. Thus, the adjacent wall portions allow for a mass distribution that aids in hitting a ball in the right direction and a structure supporting the face area that aids in hitting the ball a long distance.

Figure 10:
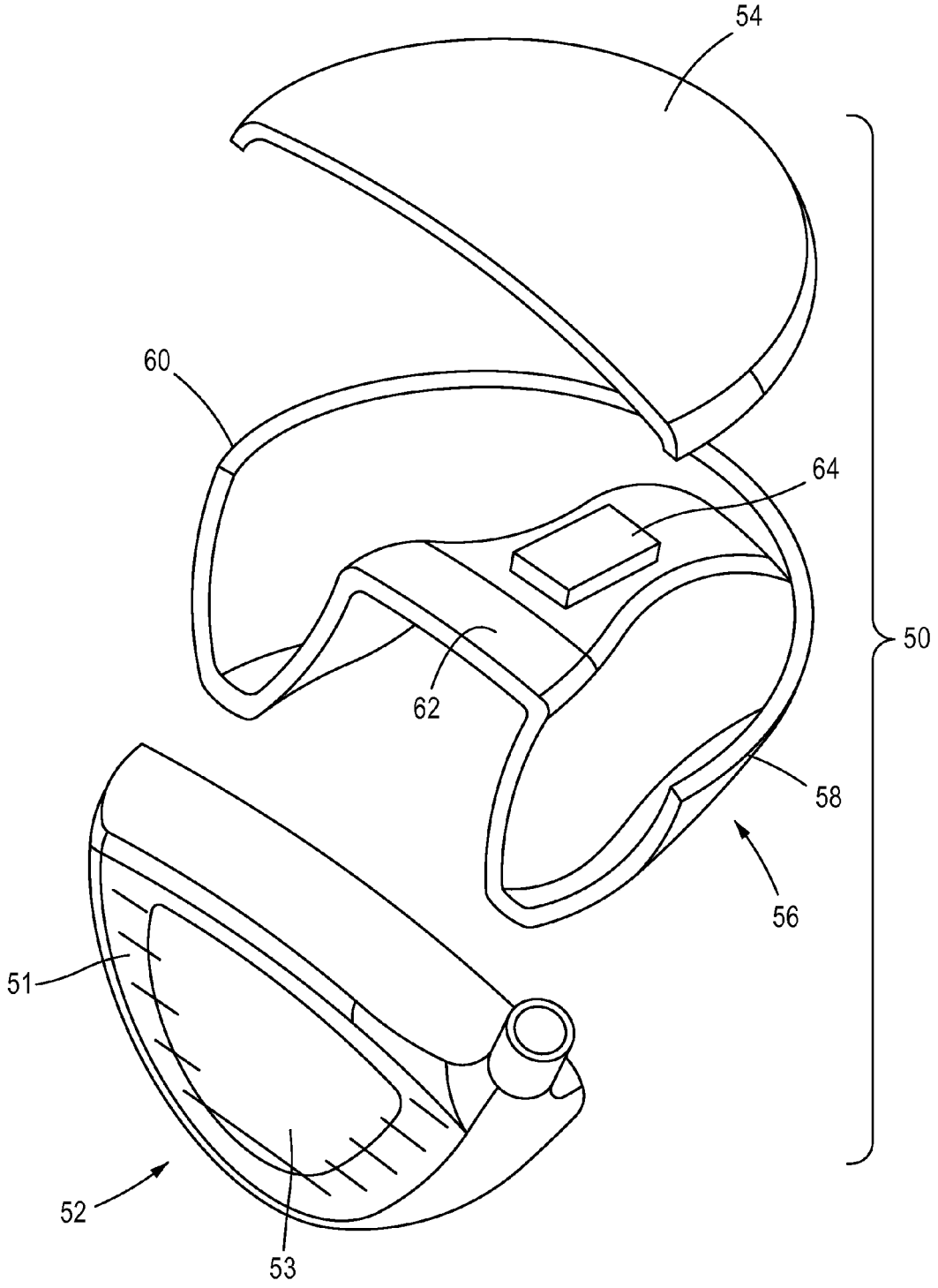
FIG. 10 is an exploded view of another embodiment of a golf club head.

Referring now to FIG. 10, golf club head 50 will be described. Golf club head 50 includes a face member 52, crown member 54 and sole member 56. Rather than having separate heel and toe body members, golf club head 50 includes a single sole member that includes a heel body portion 58, a toe body portion 60 and a raised central portion 62. Sole member 56 includes an opened upper portion that is closed by crown member 54 and an opened forward portion that is closed by face member 52 in the complete golf club head 50. Here, crown member 54 and raised central portion 62 are proximal one another (e.g., forming a bridge thickness less than about 2 cm and preferably less than 1 cm) over an area (e.g., preferably over an area of at least about 1 $cm^2$.

Face member 52 may be constructed as a single homogenous component, or it may be constructed from multiple components. Face member 52 may be a single component generally constructed as a face-cup, such as by forging, stamping or casting. In an alternate construction, face member 52 may include a face perimeter member 51 and a face insert 53 that is coupled to the face perimeter member. Face member 52 also includes a hosel 55 that is configured to receive a tip portion of a shaft in a completed golf club that incorporates club head 50.

Crown 54 extends across sole member 56 and is coupled to sole member 56 about at least a portion of its periphery. Crown 54 may also be coupled to sole member 56 at central portion 62. An insert 64 may also be included between crown 54 and central portion 62 so that portions of the inner surfaces of those bodies may be coupled in a spaced relationship to each other. From above, crown 54 includes a continuous bulbous top surface so that when golf club head 50 is at address it provides the appearance of a conventional golf club head.

Figure 11:
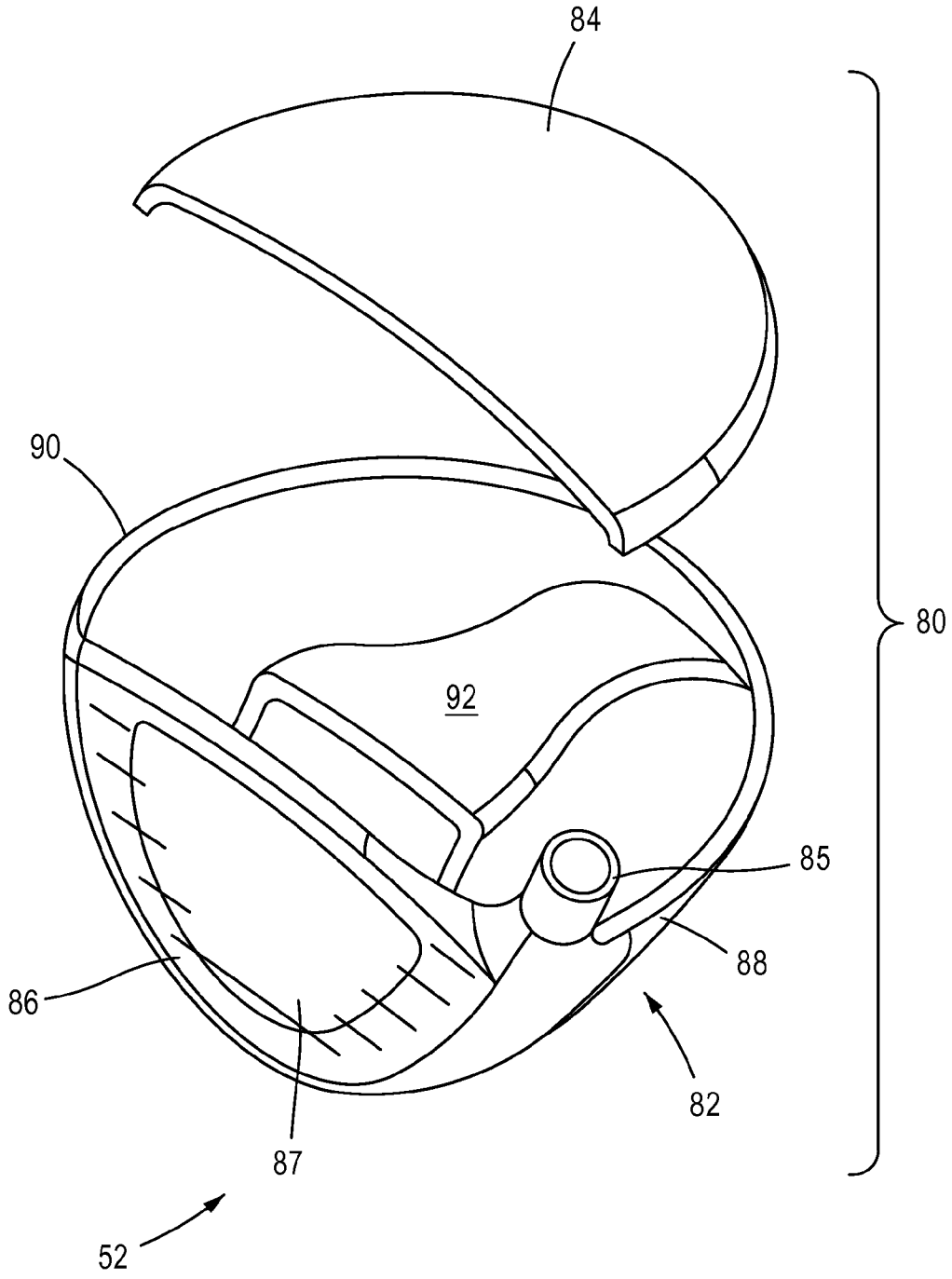
FIG. 11 is an exploded view of another embodiment of a golf club head.

In another embodiment, shown in FIG. 11, a golf club head 80 includes a lower body member 82 and a crown 84. In this alternative construction, lower body member 82 includes a hosel 85, a face portion 86, a heel body portion 88, a toe body portion 90 and a raised central portion 92. Crown 84 and raised central portion 92 provide a compressed area. Preferably, lower body member 82 is formed as a single homogeneous component, such as by casting all of the portions in a single operation. Lower body member 82 may also include integral weight members that are co-molded therewith or inserted and attached in a cavity. Lower body member 82 includes an opened upper portion that is closed by crown member 84. Face portion 86 may also include a face insert if desired. For example, lower body member 82 may be cast with a recess or aperture included in face portion 86 that receives a forged, stamped, or machined face insert 87 that is welded to face portion 86.

Crown 84 has a construction similar to those discussed previously and extends across lower body member 82 and is coupled to the lower body member about at least a portion of its periphery. Crown 84 may also be coupled to lower body member 82 at central portion 92 if desired.

Figure 12:
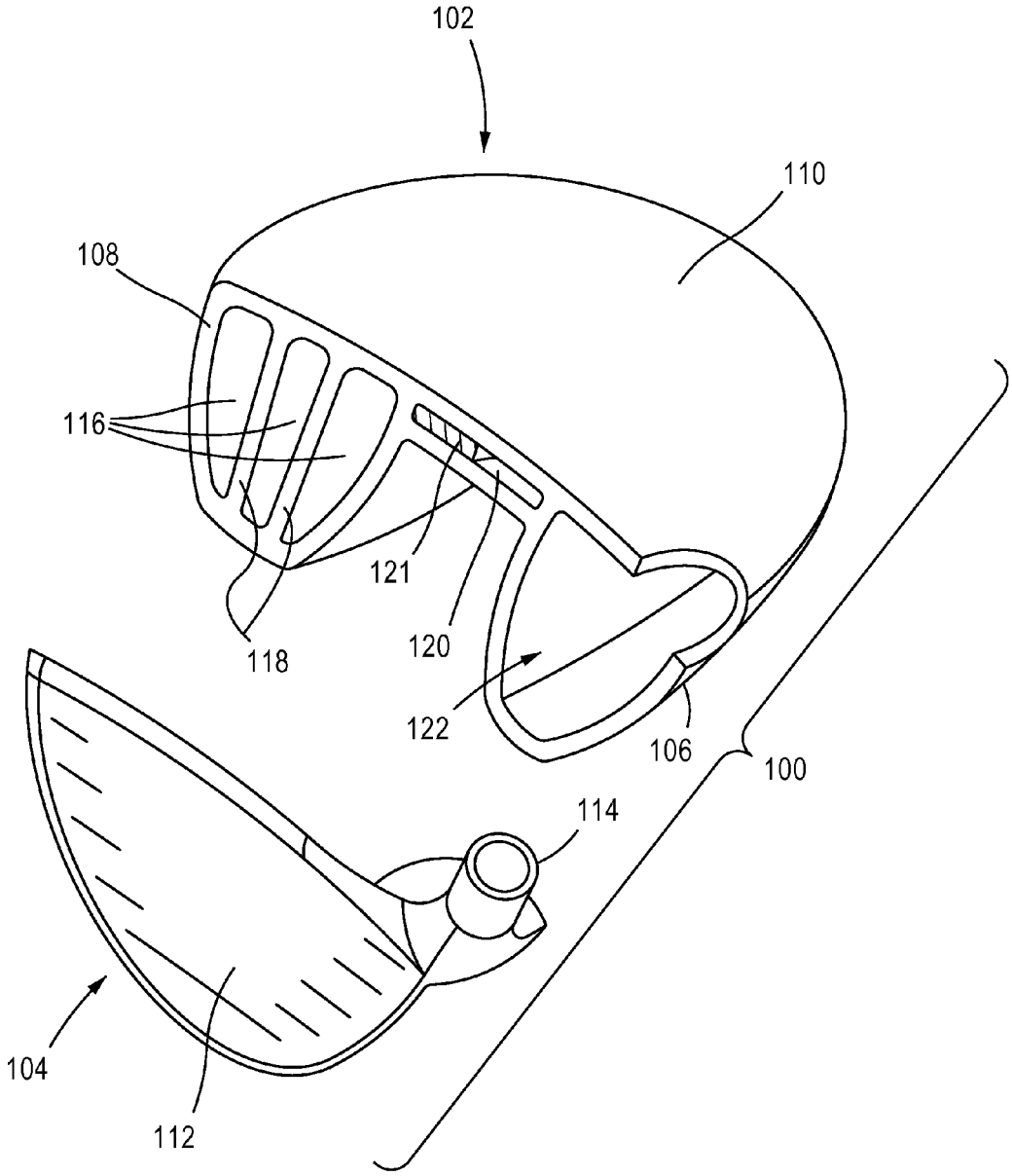
FIG. 12 is an exploded view of another embodiment of a golf club head.
Figure 13:
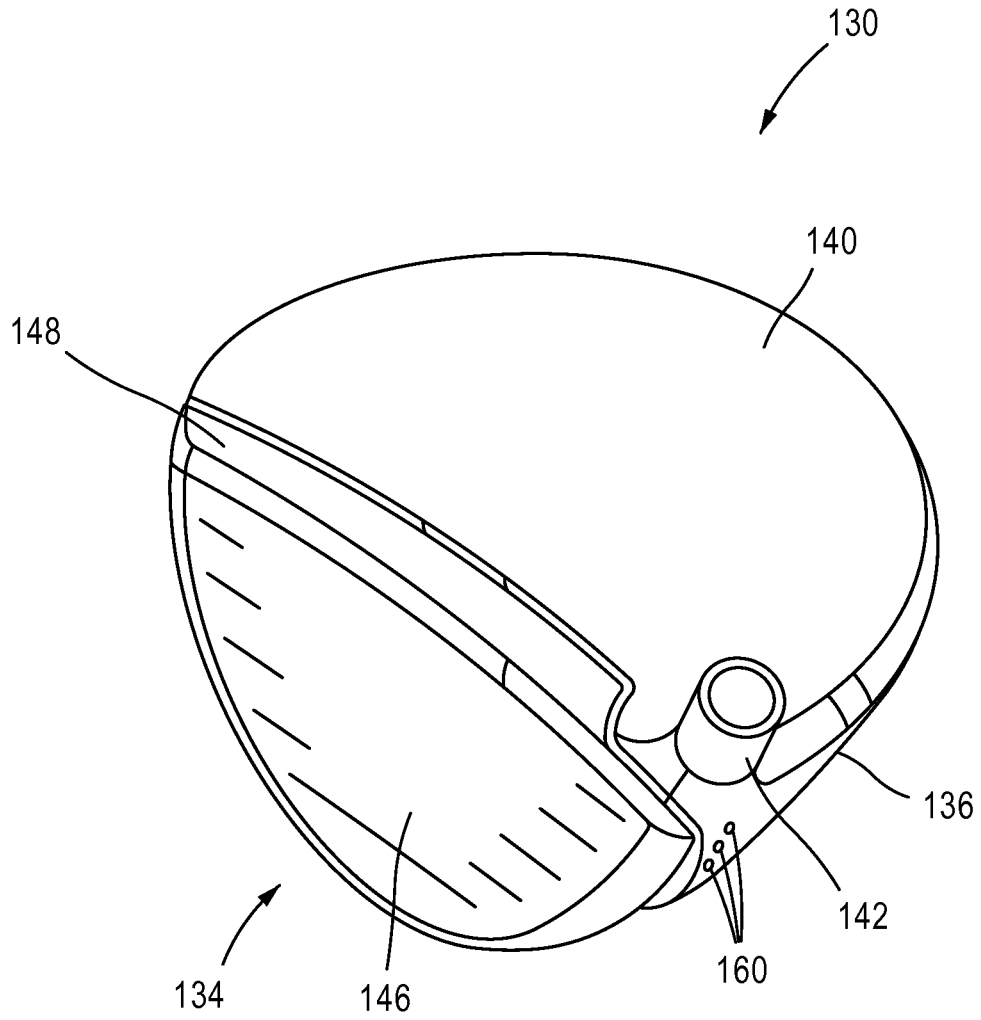
FIG. 13 is a perspective view of another embodiment of a golf club head.
Figure 14:
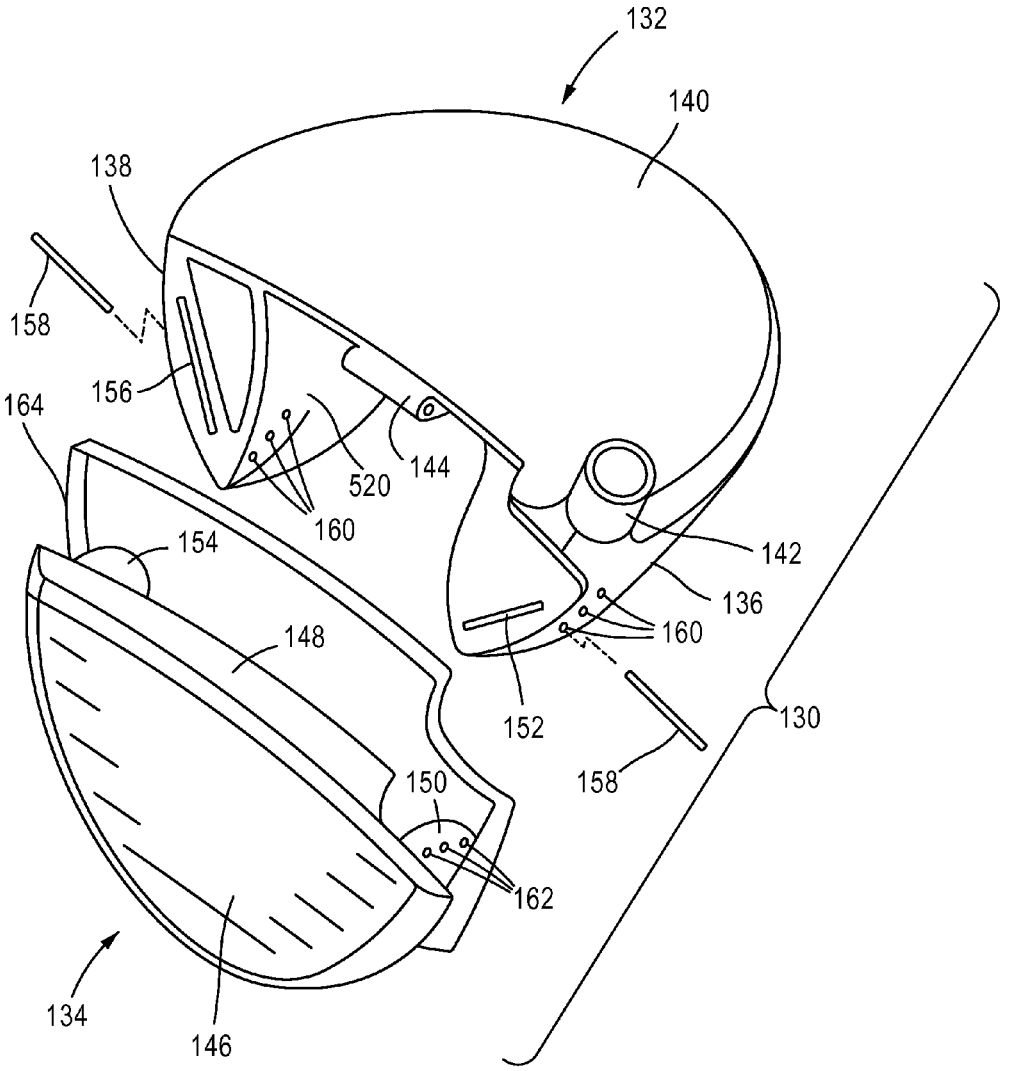
FIG. 14 is an exploded view of the golf club head of FIG. 13.
Figure 15:
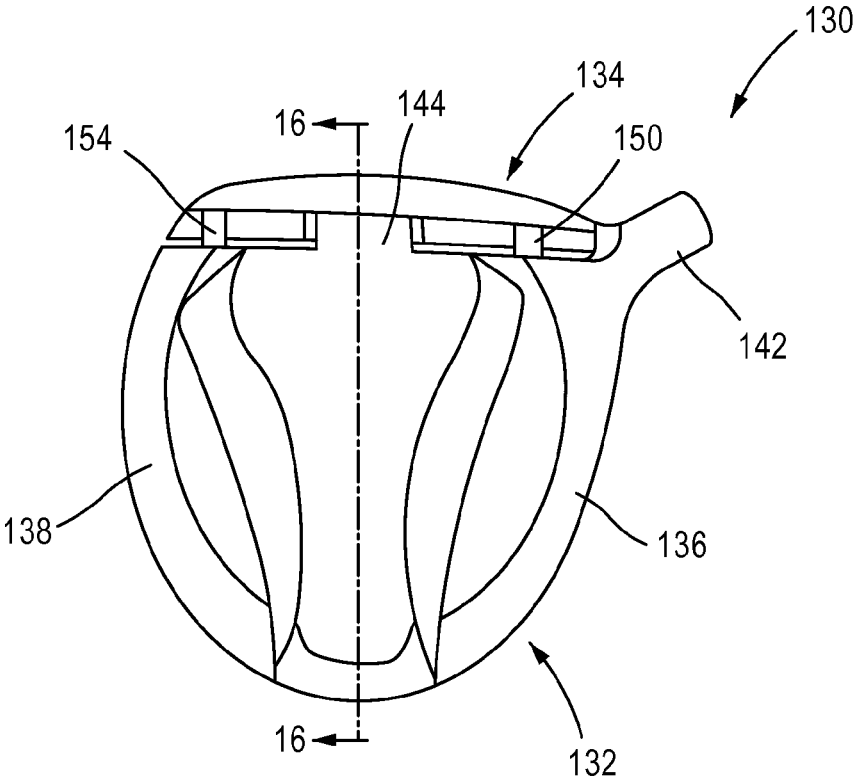
FIG. 15 is a bottom view of the golf club head of FIG. 1.
Figure 16:
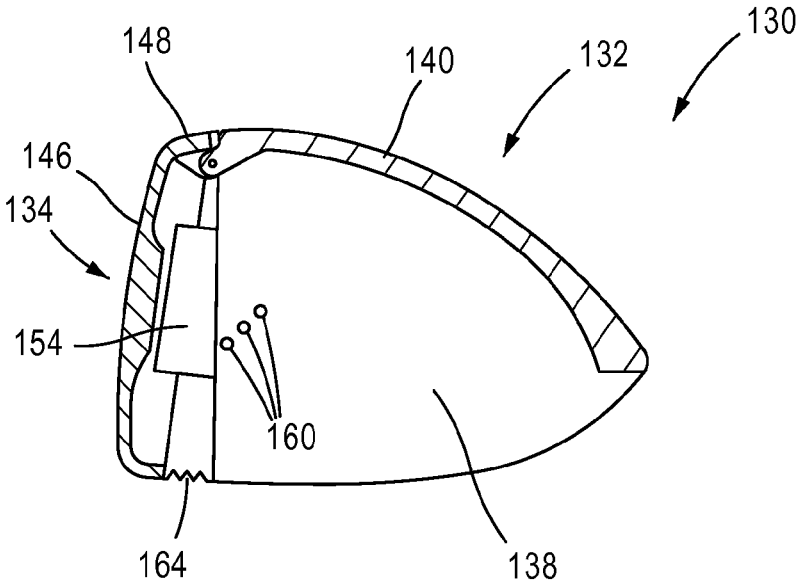
FIG. 16 is a cross-sectional view of the golf club of FIG. 13.

Referring to FIG. 12, in another embodiment, a golf club head 100 is constructed from a rear body member 102 and a face member 104. Body member 102 includes a heel body portion 106, a toe body portion 108 and a crown 110 and is generally opened toward face member 104. Face member 104 generally includes a face plate 112 and a hosel 114 and is coupled to a forward end of body member 102. It can be seen that crown 110 has a compressed portion defining a bridge thickness that less than about 2 cm, preferably less than about 1 cm.

Body member 102 defines a plurality of cavities that are generally opened forward and enclosed by the attachment of face member 104, or filled. Toe body portion 108 defines a plurality of toe cavities 116 that are separated by internal ribs 118. Although club head 100 includes three toe cavities 116, any number may be provided. Additionally, the configuration and number of ribs 118 is selected to provide desired rigidity to toe body portion 108. Moreover, a filler or inserts may be included in one or more of cavities 116. In a central region of body member 102, between the toe and heel body portions, a central cavity 120 is defined, which may be fully or partially filled if desired, such as by insert 121. Finally, heel body portion 106 defines a single heel cavity 122 that may also be fully or partially filled. It should be appreciated that the filler and/or inserts disposed in any of the cavities preferably are constructed from materials that have a specific weight that is different than the material of the remainder of body. For example, lightweight materials are generally used to alter the acoustics and/or rigidity of a portion of the golf club head and heavy materials may be used to alter the acoustics, the rigidity and/or mass distribution of the golf club head. It should be appreciated that the different portions of the golf club head may include any number of cavities.

A golfer that is in search of equipment that optimizes their performance often desires to alter various attributes of the golf club, including loft angle, face angle and lie angle. Generally, when a golfer desires to alter the loft angle of a golf club it is generally common practice to bend the hosel until the golf club head provides the desired loft angle. However, because of the conventional orientation of the hosel and the construction of the sole of a conventional golf club head, the loft angle, the lie angle and the face angle of the club head are coupled. As a result, when the hosel is bent to alter the loft angle, the lie angle and face angle may also be changed.

Referring to FIGS. 13-16, another embodiment of a golf club head according to the present invention will be described. In particular, golf club head 130 provides a structure that provides loft angle adjustment while the orientation of the shaft relative to a ground plane remains constant so that the lie angle and face angle generally remain unchanged.

Golf club head 130 generally includes a rear body member 132 and a face member 134. Body member 132 includes a heel body portion 136, a toe body portion 138, a crown 140, and a hosel 142. Body member 132 has a structure that is generally identical to the body member previously described, with regard to FIG. 12, with the addition of a hosel. Face member 134 is generally constructed as a face-cup and defines a ball-striking surface 146 and a face perimeter 148 that generally surrounds the ball-striking surface. Face member 134 may include generally constant face thickness or variable thickness, as shown.

Face member 134 is coupled to body member 132 so that they may be rotated relative to each other. In particular, the relative rotation is effectuated by a hinge 144 that couples body member 132 and face member 134. Hinge 144 includes mating portions on an underside of crown 140 and on face perimeter that engage each other and allow relative rotation between body member 132 and face member 134 about an axis that generally extends in a heel to toe direction. Alternatively, the hinge may be oriented to provide relative rotation between the body member and the face member along an axis that extends vertically so that the face angle may be adjusted independent of loft angle and lie angle. Still further, a plurality of hinges may be provided, for example one oriented to rotate about a heel to toe axis and another oriented to rotate about a vertical axis to provide adjustment of both loft angle and face angle.

Golf club head 130 also includes a hinge locking mechanism that retains body member 132 and face member 134 in a particular relative orientation. Preferably, the locking mechanism is configured to retain the components so that golf club head 130 is configured to have a plurality of predetermined lofts. For example, the locking mechanism may be constructed so that the golf club head can be configured with a loft angle of 8.5°, 9.5°, or 10.5°. The incremental change may be selected to be a constant change, such as 1° between each position, or the change may vary between positions. Preferably, the amount of each incremental angular change is between about 0.1° and about 1°. It should be appreciated that any number of positions may be provided.

In the present embodiment, the locking mechanism includes tabs attached to face member 134 that are received in cavities of body member 132 and anchored in place by pins 158. In particular, a heel tab 150 extends from a heel end of face member 134, rearward toward body member 132, and is slidably received in a heel cavity 152 of body member 132. Similarly, a toe tab 154 extends from a toe end of face member 134, rearward toward body member 132, and is slidably received in a toe cavity 156.

Body apertures 160 extend through portions of body member 132 and intersect heel cavity 152 and toe cavity 156. When the face member is in one of the predetermined orientations, corresponding tab apertures 162 align with body apertures 160 so that pins 158 may be inserted. When inserted, each pin extends across the sliding interface between the tab and cavity so that relative motion is prevented.

An optional gasket 164 may be provided to conceal or fill the gap created by the hinged interface between body member 132 and face member 134. Gasket 164 may also be configured to act as a dampener to reduce any "slop" presented by the hinged interface. Preferably, gasket is constructed from any flexible, rubber-like material.

The constructions described herein (e.g., for club head 1, 2, 50, 102, 130, etc., include heel and toe bodies that define a thinner portion there between them. Those heel and toe bodies could be described as pontoon-like bodies, and the thinner portion between them could be described as a bridge-like member, or span member 3. Heel and toe bodies and a connecting span member 3 can be defined by the inclusion of a recess in a club head crown, a recess into a club head sole, or both. Depending on the presence or absence of, and relative depths of, the crown or sole recesses, span member 3 can be disposed at any height within the club head when the club head is at address and may have any thickness. Thus, a club head of the invention can have a span member 3 extending smoothly across the crown by including a deep recess into the sole and no recess into the crown (as shown in FIGS. 1-6, 24A, and 24B). Alternatively, a club head of the invention can have span member 3 extending smoothly across the sole by including a recess in the crown (see, e.g., FIGS. 18, 19, and 20). Furthermore, span member 30 may be located at any position intermediate between the sole and crown by including both a sole recess and a crown recess (FIGS. 17, 21-23).

Figure 17:
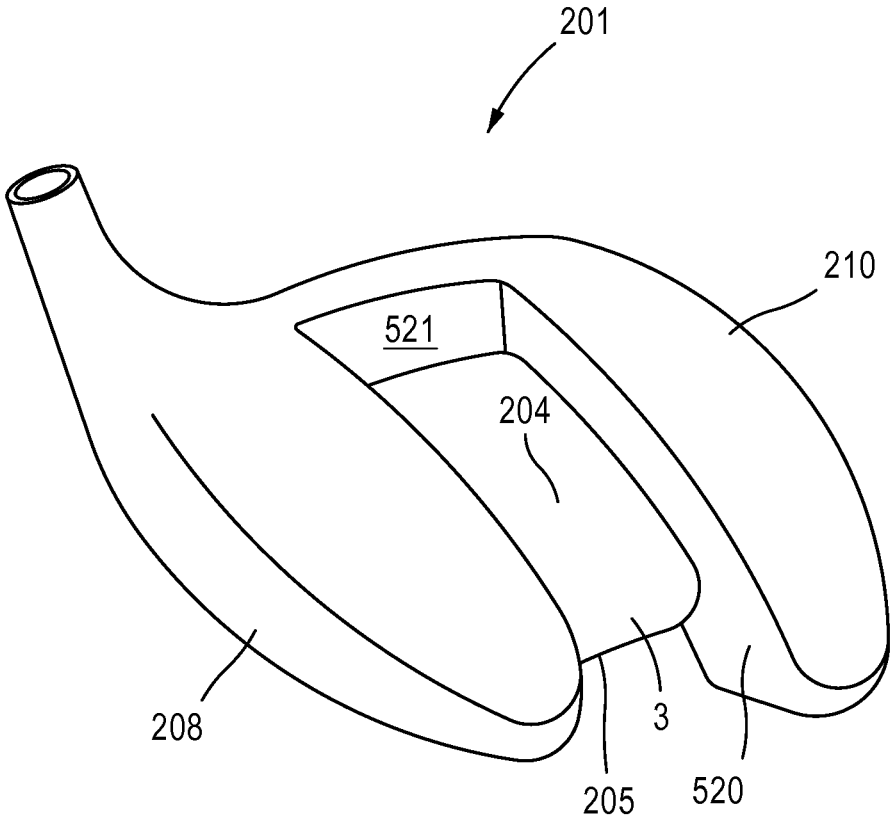
FIG. 17 is a perspective view of a club head of another embodiment.

FIG. 17 shows a wood-type golf club head 201 that includes a crown recess in the crown portion defining a compressed area. The crown recess has a crown recess floor 204 facing upward when the club is at address. A portion of crown recess floor 204 is lower than an upward-facing upper crown surface by a recess depth of at least about 2 cm when the club is at address. Preferably, the crown recess has a heel-facing inside portion extending down from the upper crown surface; a toe-facing inside portion extending down from the upper crown surface and facing the heel-facing inside portion; and an aft-facing portion extending down from the upper crown surface and extending between the heel-facing inside portion and the toe-facing inside portion. The crown recess is defined, in part, by inward facing walls 520 and aft-facing wall 521. The depth of a recess generally relates to a vertical extent of at least one of these walls.

Club head 201 includes as a compressed area a span member 3 as part of the crown that is spaced away from an area of the sole by a bridge thickness that is not greater than about 2 cm or even about 1 cm. A portion of the crown is spaced away from a portion of the sole by a vertical distance that is greater than about 2 cm in a heel-ward, forward, and toe-ward direction of the span member when the club head is at address (e.g., within heel body 208, a face area, or toe body 210). Span member 3 may include a raised central sole surface 205 that faces downwards. Raised central sole surface 205 may optionally be angled upwards from the heel side towards the toe side to define a rise angle (e.g., between about 30° and about 40°) with the horizontal when the club is at address. In some embodiments, the area of the crown that is spaced away from an area of the sole by the bridge thickness has a surface area of at least 3 $cm^2$. In certain embodiments, an entirety of the crown portion is convex upwards with no concave areas.

Figure 18:
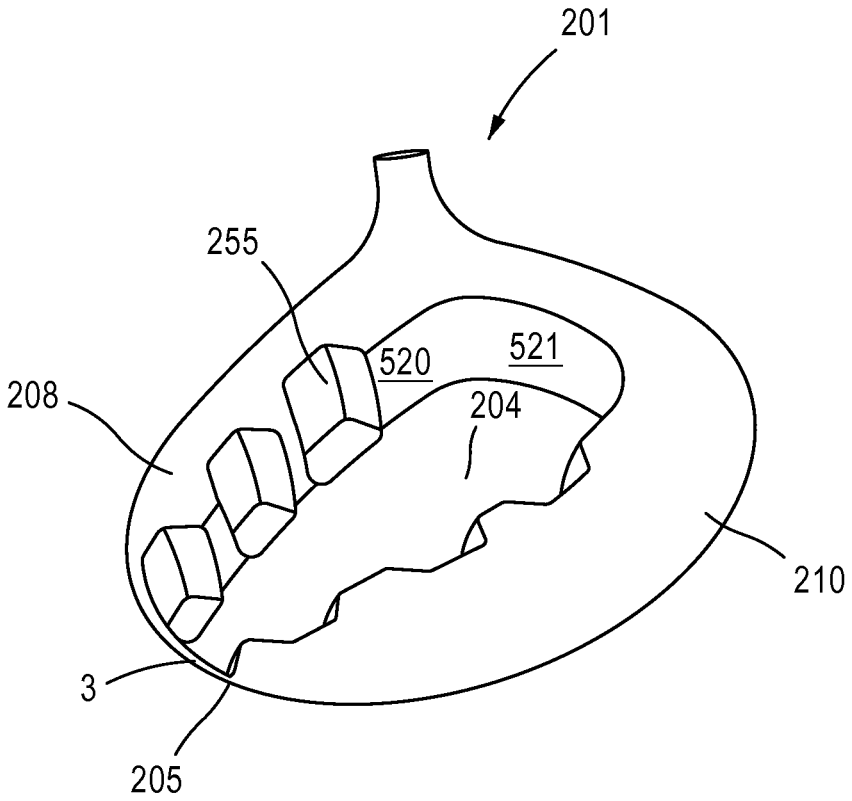
FIG. 18 is a perspective view of a club head of another embodiment.

FIG. 18 shows a club head 251 that includes a recess in the crown facing upwards and enclosed from a sole side of the club head by span member 3 (i.e., a compressed area). Here, the crown-side recess is crenellated as the inward-facing walls include a series of creneuls 255, or embrasures. Each crenel 255 may improve the rigidity of club head 251 in the vertical direction, preventing the propagation of uncomfortable vibration energy while increasing the elasticity in the face-aft direction, thereby amplifying the propagation of energy into a golf ball.

Figure 19:
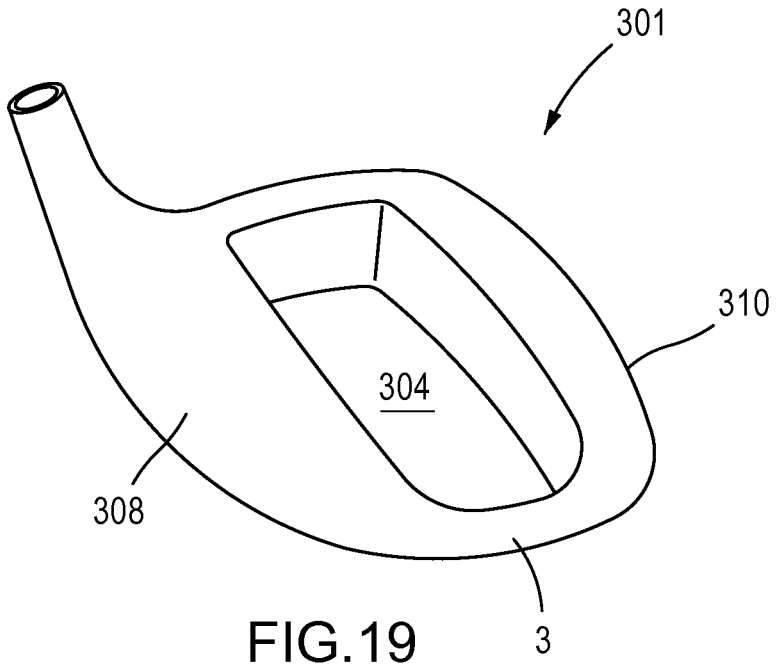
FIG. 19 perspective view of a club head of another embodiment.

FIG. 19 shows a club head 301 with a crown recess and no sole recess. The bottom of the crown recess is defined by crown recess floor 304, which cooperates with a sole surface 305 to define span member 3. Span member 3 has a bridge thickness defined by a distance from crown recess floor 304 to sole surface 305.

Figure 20:
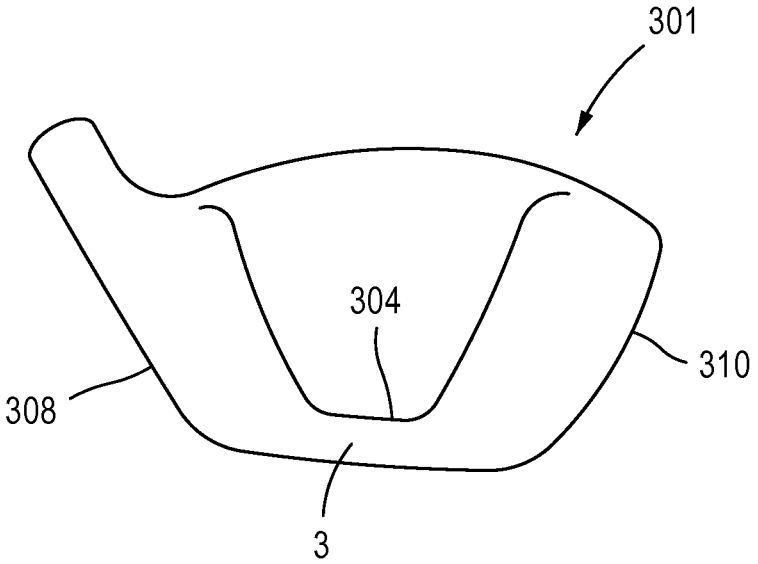
FIG. 20 is a back view of the club head of FIG. 19.

FIG. 20 gives a back view of club head 301 showing span member 3 having a bridge thickness that is not greater than about 2 cm. Preferably, a bridge thickness of span member 3 is less than about 1 cm.

A portion of the crown is spaced away from a portion of the sole by a vertical distance that is greater than about 2 cm within heel body 308, toe body 310 and in the face area. In some embodiments, the area of crown recess floor 304 that is spaced away from sole surface 305 by the bridge thickness has a surface area of at least 3 $cm^2$. In certain embodiments, an entirety of sole surface 305 is convex downwards with no concave areas.

Figure 21A:
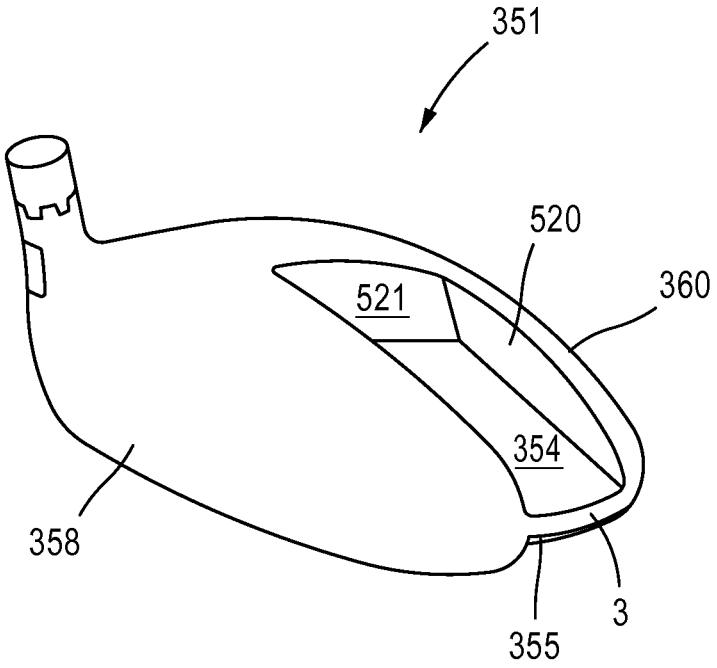
FIG. 21A is a perspective view of a club head of another embodiment.

FIG. 21A shows an alternative embodiment in which club head 351 includes a crown recess as well as a sole recess in the sole portion. The crown recess has a heel-facing inside portion extending down from the upper crown surface; a toe-facing inside portion extending down from the upper crown surface and facing the heel-facing inside portion; and an aft-facing portion extending down from the upper crown surface and extending between the heel-facing inside portion and the toe-facing inside portion. Crown recess floor 354 faces upwards (i.e., meaning substantially upwards, or visible from above) when club head 351 is at address. The sole recess has a second heel-facing inside portion extending upwards from a lower sole surface, a second toe-facing inside portion extending upwards from the lower sole surface and facing the heel-facing inside portion, a second aft-facing portion extending upwards from the lower sole surface and between the second heel-facing inside portion and the second toe-facing inside portion, and a sole recess ceiling 355 facing downwards when the club is at address. The crown recess is defined, in part, by inward facing walls 520 and aft-facing wall 521. The depth of a cavity or recess generally relates to a vertical extent of one of these walls (e.g., a height of the wall in a vertical direction when the club head is at address).

Figure 21B:
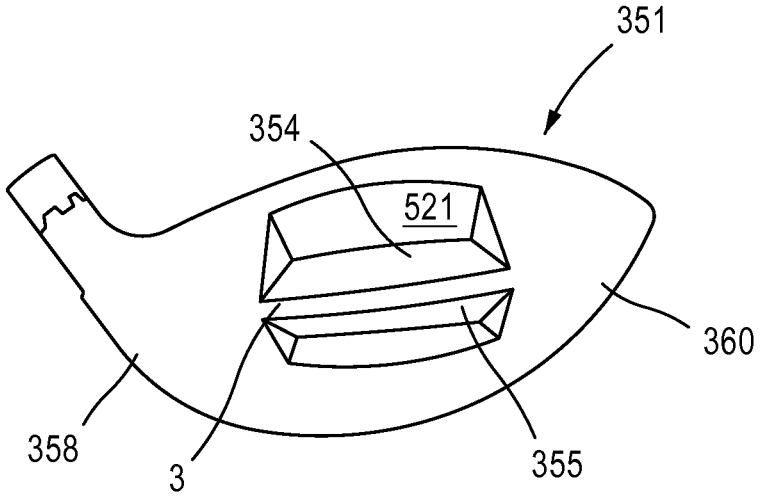
FIG. 21B is a back view of the club head of FIG. 21A.

FIG. 21B is a back view of club head 351. Club head 351 includes span member 3 extending between heel body 358 and toe body 360. Span member 3 has a bridge thickness measurable between crown recess floor 354 and sole recess ceiling 355. The bridge thickness may be less than about 1 cm. Heel body 358 and toe body 360 along with a face area define a portion of the crown that is spaced away from a portion of the sole by a vertical distance that is greater than about 2 cm in a heel-ward, forward, and toe-ward direction of the span member when the club head is at address.

Figure 21C:
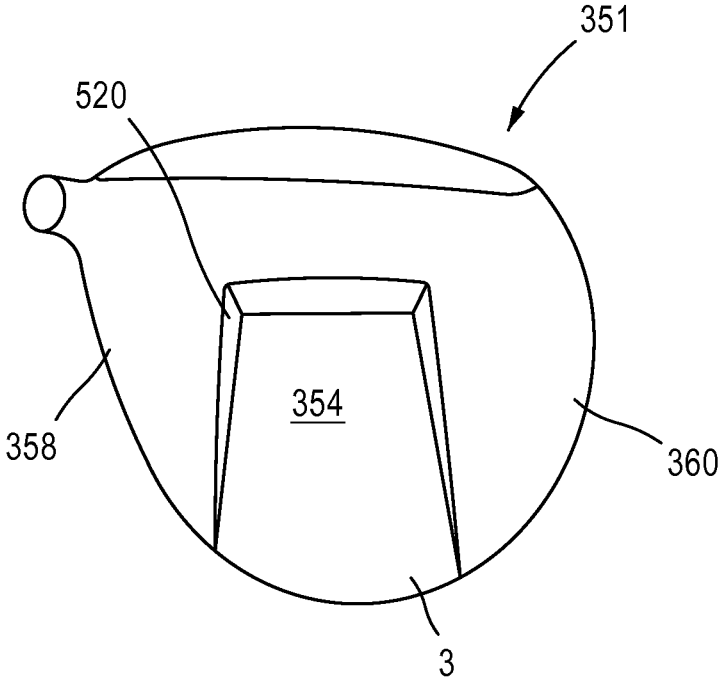
FIG. 21C is a top view of the club head of FIG. 21A.

FIG. 21C is a top view of club head 360 showing how the inward facing walls may be sloped somewhat to be visible from above at address. This can provide a useful alignment aid. The area bounded by those inward facing walls may be the area of the crown that is spaced away from an area of the sole by the bridge thickness. This area, as shown in FIG. 21C, may have a surface area of at least 3 $cm^2$. Optionally, span member 3 may include a raised central sole surface that faces downwards and is angled upwards from the heel side towards the toe side to define a rise angle (e.g., between about 30° and about 40°) with the horizontal when the club is at address.

It can be seen from FIG. 21B that span member 3 is located intermediate between a top of the crown and a bottom of the sole, somewhat close to the middle. A span member may be closer to the crown or to the sole, depending on the needs of a golfer.

Figure 22A:
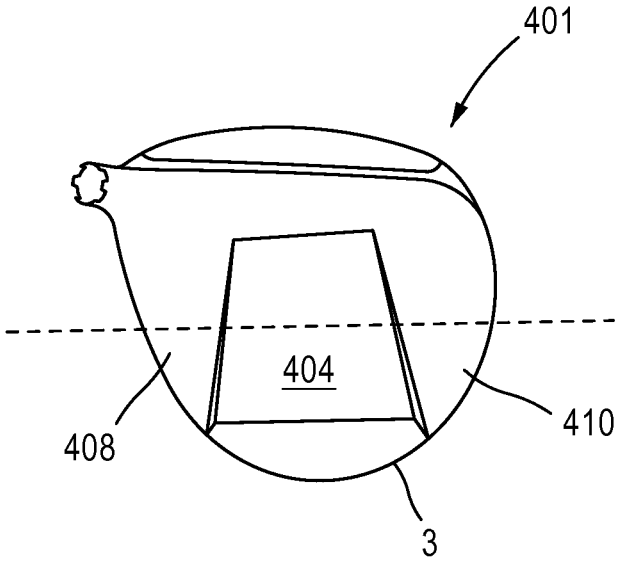
FIG. 22A is a top view of a club head of another embodiment.

FIG. 22A shows a club head 401 in which a span member 3 is located high, near the crown of head 401. Span member 3 extends between heel body 408 and toe body 410. A top surface of span member 3 (i.e., crown recess floor 404) slopes gently downwards from face towards aft, and then turns and forms a flat portion that is more horizontal when club head 401 is at address.

Figure 22B:
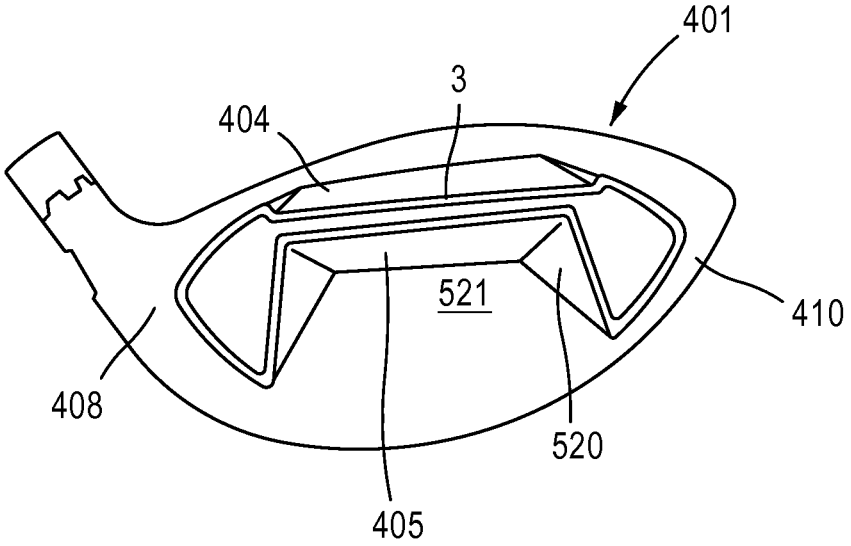
FIG. 22B is a cross-sectional view of the club head of FIG. 22A.

FIG. 22B is a cross-sectional view of the club head 401 along the dotted line in FIG. 22A. Span member 3 preferably has a bridge thickness that is not greater than about 2 cm or even about 1 cm. Heel body 408 and toe body 410, along with a face portion, define a part of the crown that is spaced away from the sole by a vertical distance that is greater than about 2 cm in a heel-ward, forward, and toe-ward direction of the span member when the club head is at address.

Span member 3 includes a raised central sole surface 405 that faces downwards. In some embodiments, the area of the crown that is spaced away from an area of the sole has a surface area of at least 3 $cm^2$ (i.e., the area of crown recess floor 404 that is bounded by the sloped triangular walls shown in FIG. 22A is greater than about 3 $cm^2$). As in all embodiments shown herein, certain geometries are depicted as illustrative examples and are not limiting. The rounding of transitions (e.g., from an uppermost surface of a crown to the inward-facing and sloped triangular walls shown in FIG. 22A) may be very sharp, gently rounded, or intermediate.

As shown in FIG. 22B, heel body 408, toe body 410, raised central sole surface 405, and the face portion of club head 401 combine to define a central cavity underneath the club head. The central cavity is openly exposed downward. Crown recess floor 404 provides an upper surface of the crown body that is spaced away from the raised central sole surface 405 by a bridge thickness that may be less than about 2 cm. Preferably, the bridge thickness is less than about 1 cm. The raised central sole surface 405 may be higher than the lower surface of the heel body by a recess depth that is at least about 2 cm when the club is at address.

With reference back to FIG. 22A, club head 401 may include a crown recess in which a crown recess floor 404 faces upward when the club is at address. Part of crown recess floor 404 may be lower than an upward-facing upper crown surface by a recess depth of at least about 0.1 cm when the club is at address. The recess depth may be at least about 2 cm.

Figure 23:
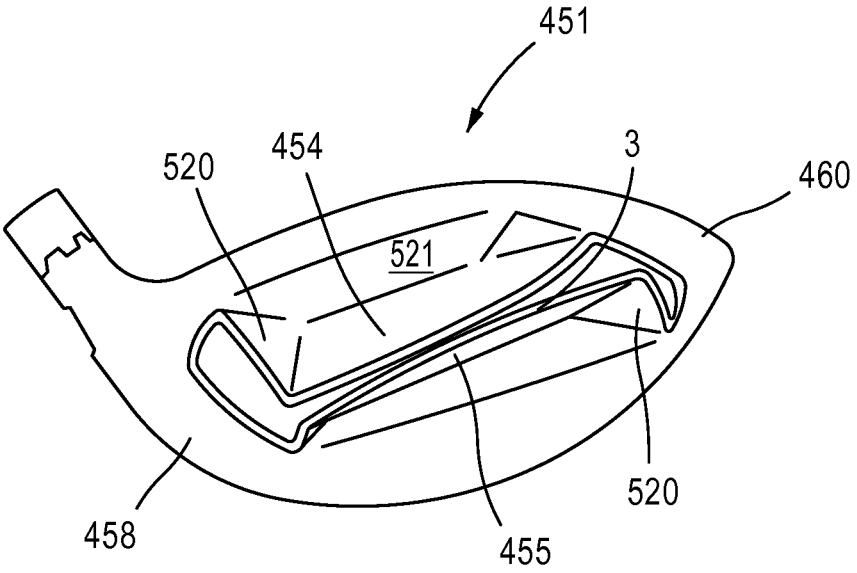
FIG. 23 is a cross-sectional view of an alternative construction of a club head.

FIG. 23 shows a club head 451. Club head 451 is similar to club head 401 but span member 3 in club head 451 is more tilted relative to the horizontal when the club head is at address than in club head 401. Span member 3 in club head 451 extends from a low portion of heel body 458 to a high portion of toe body 460. Tilting span member 3 relative to the horizontal provides an excellent benefit in that the mass distribution of span member 3 is concentrated in a plane that intersects a striking face of the club head substantially along a major axis of an ellipse that best fits a pattern of actual ball strikes. It is thought that many players hit balls in spots on the club face that define an ellipse over many hits. It is thought to be beneficial to increase Moment of Inertia around a minor axis of that ellipse, where prior art club heads merely increased moment of inertia about a z-axis. The minor axis of the actual hit pattern ellipse may deviate from a z-axis in the heel-toe direction (when the club head is at address) by a hit pattern angle that is between about 10° and about 50°, and may be more precisely between about 20° and about 40°. Accordingly, a plane that bisects span member 3 may extend upward from the horizontal in the heel to toe direction (when the club head is at address) by a rise angle that is between about 10° and about 50°, and may be more precisely between about 20° and about 40°. The hit pattern and inertial axes are discussed in U.S. Pub. 2013/0029780 to Beno, the contents of which are incorporated by reference. In some embodiments, span member 3 is included as part of the crown that is spaced away from an area of the sole by a bridge thickness that is not greater than about 2 cm or even about 1 cm. A portion of the crown is spaced away from a portion of the sole by a vertical distance that is greater than about 2 cm in a heel-ward, forward, and toe-ward direction of the span member (when the club head is at address) in the face-cup area, toe body 460, and heel body 458. In some embodiments, crown recess floor 454, sole recess ceiling 455, or both have a surface area of at least 3 $cm^2$. In certain embodiments (not depicted in FIG. 23), an entirety of the crown portion is convex upwards with no concave areas.

Figure 24A:
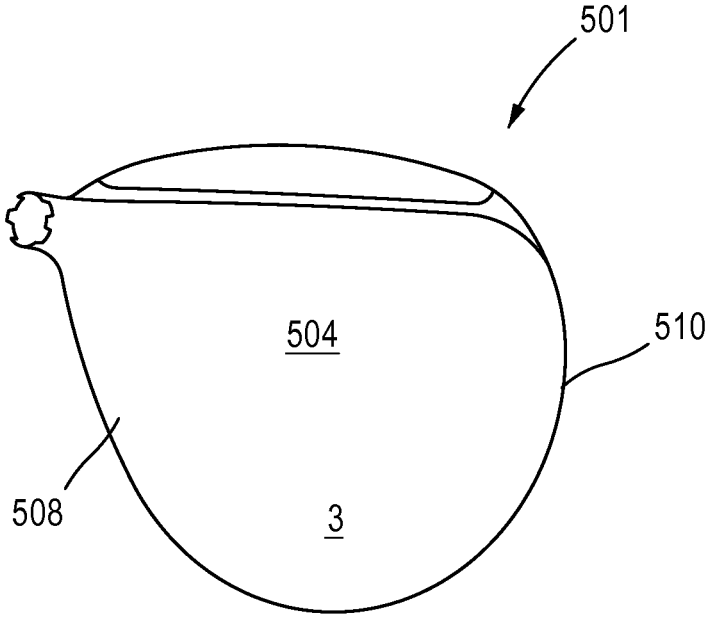
FIG. 24A is a top view of a club head of another embodiment.

FIG. 24A shows a club head 501 in which an entirety of the crown portion 504 is convex upwards with no concave areas. Club head 501 includes a heel body 508 and a toe body 510 that extend downwards (when the club is at address), as does a face-cup area of the club head body. A sole surface includes a lower surface of the heel body, a lower surface of the toe body, and a raised central sole surface 505 of the club head and extends between the heel and toe bodies. A face body provides a ball striking surface. The face body extends forward from the crown body, the heel body, the toe body, and the raised central sole surface. The raised central sole surface does not form a part of the face body.

Figure 24B:
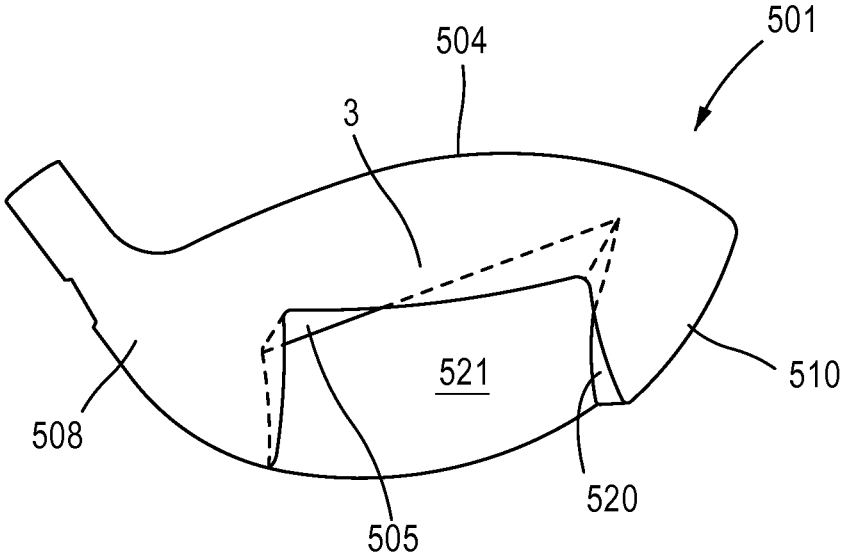
FIG. 24B is a back view of the club head shown in FIG. 24A.

FIG. 24B is a back view of the club head shown in FIG. 24A. Heel body 508, toe body 510, raised central sole surface 505, and the face body combine to define a central cavity underneath the club head. The central cavity is openly exposed downward. An upper surface of the crown body is spaced away from raised central sole surface 505 to define span member 3. Span member 3 may have a bridge thickness that is less than about 6 cm, for example, less than 2 cm, preferably less than 1 cm for a portion of raised central sole surface with an area of at least about 3 $cm^2$. The raised central sole surface 505 may be higher than the lower surface of the heel body by a recess depth that is at least about 2 cm when the club is at address. The bridge thickness can be less than about 1 cm. A portion of the crown is spaced away from a portion of the sole by a vertical distance that is greater than about 2 cm in a heel-ward, forward, and toe-ward direction of the span member when the club head is at address, i.e., along heel body 508, toe body 510 and just behind the striking face.

As shown in FIG. 24B, raised central sole surface 505 faces downwards and is angled upwards from the heel side towards the toe side to define a rise angle (e.g., between about 30° and about 40°) with the horizontal when the club is at address. In some embodiments, the area of the crown that is spaced away from an area of the sole by the bridge thickness has a surface area of at least 3 $cm^2$. As shown in FIGS. 24A and 24B, an entirety of the crown portion is convex upwards with no concave areas. The rise angle provides a beneficial utility in optimizing the MOI according to actual hit patterns. The dimensions of the sole recess described provide a beneficial utility in optimizing a coefficient of restitution of the club head. Additional, height of span member 3 (e.g., closer to crown or closer to sole) can be varied to optimizes vertical center of gravity for club heads for players with different needs.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

As used herein, the word "or" means "and or or", sometimes seen or referred to as "and/or", unless indicated otherwise.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

The invention claimed is:

1. A wood-type golf club head comprising:

a striking face;

a crown portion extending from the face;

a sole portion extending from the face and joining the crown portion at a heel side, a toe side, and an aft area when the club head is at address; and a hosel extending from the heel side, wherein a first portion of a club head wall is spaced away from a second portion of the club head wall by a bridge thickness not greater than about 2 cm over an area of at least about 1 $cm^2$, wherein the first portion is within the crown portion and the second portion is within the sole portion, the club head further comprising a crown recess in the crown portion, wherein the first portion defines a crown recess floor facing upward when the club head is at address, wherein a portion of the crown recess floor is lower than an upward-facing upper crown surface by a recess depth of at least about 2 cm when the club head is at address.

2. The club head of claim 1, wherein the crown recess further comprises: a heel-facing inside portion extending down from the upper crown surface; a toe-facing inside portion extending down from the upper crown surface and facing the heel-facing inside portion; and an aft-facing portion extending down from the upper crown surface and extending between the heel-facing inside portion and the toe-facing inside portion.

3. The club head of claim 1, wherein a portion of the crown recess floor is angled upwards from the heel side towards the toe side to define a rise angle with the horizontal when the club head is at address.

4. The club head of claim 3, wherein the rise angle is between about 20° and about 40°.

5. A golf club head, comprising:

a crown body including a heel portion and a toe portion;

a heel body extending downward from the heel portion of the crown;

a toe body extending downward from the toe portion of the crown;

a sole surface comprising a lower surface of the heel body, a lower surface of the toe body, and a raised central sole surface of the club head extending between the heel and toe bodies; and a face body including a ball striking surface, the face body extending forward from the crown body, the heel body, the toe body, and the raised central sole surface, the raised central sole surface not forming a part of the face body, wherein the heel body, the toe body, the raised central sole surface, and the face body combine to define a central cavity underneath the club head openly exposed downward, wherein an upper surface of the crown body is spaced away from the raised central sole surface by a bridge thickness that is less than about 2 cm, wherein a portion of the raised central sole surface is angled upwards from the heel body towards the toe body to define a rise angle with the horizontal when the club head is at address, wherein the rise angle is between about 20° and about 40°.

6. A golf club head, comprising:

a crown body including a heel portion and a toe portion;

a heel body extending downward from the heel portion of the crown;

a toe body extending downward from the toe portion of the crown;

a sole surface comprising a lower surface of the heel body, a lower surface of the toe body, and a raised central sole surface of the club head extending between the heel and toe bodies;

a face body including a ball striking surface, the face body extending forward from the crown body, the heel body, the toe body, and the raised central sole surface, the raised central sole surface not forming a part of the face body; and a crown recess in the crown body, the crown recess comprising a crown recess floor facing upward when the club head is at address, wherein a portion of the crown recess floor is lower than an upward-facing upper crown surface by a recess depth of at least about 0.1 cm when the club head is at address, wherein the heel body, the toe body, the raised central sole surface, and the face body combine to define a central cavity underneath the club head openly exposed downward, wherein an upper surface of the crown body is spaced away from the raised central sole surface by a bridge thickness that is less than about 2 cm.

7. The club head of claim 6, wherein the recess depth is at least about 2 cm.

8. A golf club head, comprising:

a striking face;

a crown portion extending from the face;

a sole portion extending from the face and joining the crown portion at a heel side, a toe side, and an aft area when the club head is at address;

a hosel extending from the heel side;

a span member comprising an area of the crown that is spaced away from an area of the sole by a bridge thickness that is not greater than about 2 cm;

wherein a portion of the crown is spaced away from a portion of the sole by a vertical distance that is greater than about 2 cm in a heel-ward, forward, and toe-ward direction of the span member when the club head is at address, wherein the span member comprises a raised central sole surface that faces downwards and is angled upwards from the heel side towards the toe side to define a rise angle with the horizontal when the club head is at address, wherein the rise angle is between about 30° and about 40°.

9. A wood-type golf club head, comprising:

a striking face;

a crown portion extending from the face;

a sole portion extending from the face and joining the crown portion at a heel side, a toe side, and an aft area when the club head is at address, wherein the sole portion comprises a heel body, a toe body, and a raised central sole surface that define a central cavity underneath the club head when the club head is at address, wherein the central cavity is openly exposed downward, wherein an upper surface of the crown portion is less than 2 cm away from the raised central sole surface to define a span member and a portion of the crown is spaced away from a portion of the sole by a vertical distance that is greater than 2 cm in a heel-ward, forward, and toe-ward direction from the span member; and a hosel extending from the heel side, wherein the raised central sole surface faces downward and is angled upwards from the heel body towards the toe body to define a rise angle between 20° and 40° with the horizontal when the club head is at address.

10. The club head of claim 9, wherein an entirety of the crown portion is convex upwards with no concave areas.

* * * * *